US007503769B2

(12) United States Patent
Ohtsuki et al.

(10) Patent No.: US 7,503,769 B2
(45) Date of Patent: Mar. 17, 2009

(54) CONNECTOR AND PUSHING JIG

(75) Inventors: Tomonari Ohtsuki, Koto-ku (JP); Yasue Yamazaki, Koto-ku (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/762,671

(22) Filed: Jun. 13, 2007

(65) Prior Publication Data

US 2007/0298645 A1 Dec. 27, 2007

(30) Foreign Application Priority Data

Jun. 22, 2006 (JP) ..... 2006-172405
Jun. 22, 2006 (JP) ..... 2006-172407
Jun. 27, 2006 (JP) ..... 2006-176181

(51) Int. Cl.
*H01R 12/00* (2006.01)

(52) U.S. Cl. ..... 439/66; 439/496; 439/354

(58) Field of Classification Search ..... 439/496, 439/354, 66
See application file for complete search history.

(56) References Cited

U.S. PATENT DOCUMENTS 3,825,878 A * 7/1974 Finger et al. ..... 439/493
6,086,412 A * 7/2000 Watt et al. ..... 439/496
6,244,890 B1 * 6/2001 Fuerst et al. ..... 439/357
6,739,903 B1 * 5/2004 Aoki et al. ..... 439/496

FOREIGN PATENT DOCUMENTS

| | | |
|---|---|---|
| JP | 10-032062 | 2/1998 |
| JP | 2002-175859 | 6/2002 |
| JP | 2004-241304 | 5/2004 |
| JP | 2005-302705 | 10/2005 |

* cited by examiner

*Primary Examiner*—Truc T Nguyen
(74) *Attorney, Agent, or Firm*—Hogan & Hartson LLP

(57) ABSTRACT

A connector includes contact conductors each having two contact portions and a conductor connecting the two contact portions arranged on a flexible printed circuit board folded back so that the contact portions arranged its front and rear faces can be connected to contacts of connecting objects, pushing device provided on the circuit board, and an elastic member arranged between the contact portions on the front and rear faces. Another connector includes a flexible printed circuit board not being folded back, an elastic member held on the side of the circuit board opposite from the contact portions, and at least one pushing member for pushing the circuit board and the connecting objects. A pushing jig includes pushing portions provided on a base material to be pushed against connecting objects, an elastic member held on the base material opposite side of the pushing portions, and at least one pushing member for pushing the base material and the connecting objects. With these constructions, a reduced overall distance between the substrates is possible, and a narrower pitch and stable connection can be obtained.

15 Claims, 26 Drawing Sheets

CONNECTOR AND PUSHING JIG

CROSS REFERENCE TO THE RELATED APPLICATION

This application claims benefit of priority under 35 U.S.C. § 119 to Japanese Patent Application No. 2006-172405 filed Jun. 22, 2006, Japanese Patent Application No. 2006-172407 filed Jun. 22, 2006 and Japanese Patent Application No. 2006-176181 filed Jun. 27, 2006, the entire contents of all of which are incorporated by reference in their entirety.

BACKGROUND OF THE INVENTION

This invention relates to a connector for use with electric or electronic appliances for the purpose of connecting substrates or connecting a substrate and a flexible printed circuit board, and more particularly to a pushing jig for pushing the connector to mating objects, and these connector and pushing jig achieving narrower pitches and higher mounting density.

In order to connect substrates or a substrate and a flexible printed circuit board used in electric and electronic appliances, in general, two connectors (so-called substrate-connecting connectors) each mounted on the respective substrate are fitted with each other. In recent years, however, a requirement for a reduced overall distance between substrates has become stronger.

As described above, connectors are used for many cases connecting substrates or connecting a substrate and a flexible printed circuit board. Incorporated herein are Japanese Patent Application Opened No. H10-32,062 (1998) proposed by the applicant of the present application using two connectors for connecting two substrates and using a flexible printed circuit board as contacts (Patent Literature 1), and Japanese Patent Application Opened No. 2002-175,859 (Patent Literature 2), Japanese Patent Application Opened No. 2004-241,304 (Patent Literature 3) and Japanese Patent Application Opened No. 2005-302,705 (Patent Literature 4) these having contact portions in the form of a spiral adapted to contact mating objects.

Patent Literature 1

According to the abstract of the Japanese Patent application Opened No. H10-32,062 (1998), this invention has an object to provide an electrical connector 10 which is mounted on a substrate and able to be connected to a mating connector mounted on a substrate irrespective of positional deviation (of the order of 0.5 mm) between the substrates. Disclosed is a connector structure including an insulator 12, contacts 14 having a flexibility, and means for holding and fixing said contacts 14 in the insulator 12. Further disclosed is a structure of the contacts 14 each comprising two contact members 16 attached to each other and each of the contact members 16 consisting of a conductor 19 and insulating layers A18 and B20 embracing the conductor 19 therebetween.

Patent Literature 2

According to the abstract of the Japanese Patent Application Opened No. 2002-175,859, this invention has an object to provide a spiral contactor, semiconductor testing device (test socket, test board, and probe card), and electronic part (mounting socket and mounting connector), which can be used for small type semiconductor devices, packages, micro bare chips and wafer-shaped objects, which can form electric circuits without causing spherical connection terminals of a soft material to be deformed or scratched, which can tolerate high density of spherical connection terminals, and which is inexpensive and can realize highly reliable inspection. Disclosed is a contactor adapted to be electrically connected to a semiconductor device or electronic part having spherical connection terminals, comprising spiral contact elements 2 having a spiral shape as viewed in a plan view and adapted to contact said spherical connection terminals, and an insulating substrate on which said spiral contact elements are arranged such that said spiral contact elements are deformable depending upon the shape of said spherical connection terminals when the spiral contact elements come into contact with said spherical connection terminals, thereby enabling electrical connection with the semiconductor device or electronic part.

Patent Literature 3

According to the abstract of the Japanese Patent Application Opened No. 2004-241,304, this invention has an object to provide an electronic connector which is capable of achieving a miniaturization of the connector by reducing a total number of grounding terminals and has good transmission characteristics even within high frequency zone. Disclosed is an electronic connector provided with spiral contact elements 7 as signal terminals at the center and with grounding terminals 8 arranged about the spiral contact elements 7 so that one signal terminal can be electro-magnetically shielded by one grounding terminal 8, thereby providing an electronic connector superior in transmission characteristics even in high frequency zone, and enabling a miniaturization of the connector owing to more reduction in number of ground terminals in comparison with prior art.

Patent Literature 4

According to the abstract of the Japanese Patent Application Opened No. 2005-302,705, this invention has an object to provide a connector which is miniaturized by reducing the mounting area and superior in high frequency characteristics. Disclosed is a connector including a plurality of spiral contact elements 20 formed on an upper surface 3*a* as a first surface of a substrate 3, and a plurality of connection terminals 40 formed on a lower surface 3*b* as a second surface of the substrate 3 so that said spiral contact elements 20 and said connection terminals 40 are electrically connected and the plurality of said spiral contact elements 20 are arranged in a plane matrix on the upper surface 3*a* as the first surface of the substrate, with the result that it becomes possible to provide said many spiral contact elements 20 on the substrate to achieve a substantial miniaturization of the connector 1, and it is possible to improve the high frequency characteristics by the spiral contact elements 20.

As described above, in recent years the requirement for a reduced overall distance between substrates has become stronger. The devices and connectors disclosed in the Patent Literatures 2 to 4 may be used to response to such a requirement for the reduced overall distance between substrates. With the constructions disclosed in the Patent Literatures 2 to 4, however, as the contact portions adapted to contact mating objects are spiral, the contact portions become unavoidably larger so that narrower pitches cannot be achieved. Due to the spiral shapes of the contact portions, moreover, the contact pressure is poor, with the result that stable connection cannot be realized. Further, such spiral contact portions are not suitable for repeated contacts.

SUMMARY OF THE INVENTION

In view of the problems described above, it is an object of the invention to provide a connector enabling a reduced overall height or distance between two substrates, and achieving narrower pitches and stable connection even in the case of repeated connections, and further to provide a pushing jig for pushing the connector to mating objects.

The object described above is accomplished by the connector 10 defined in claim 1 according to the invention comprising a plurality of contact conductors 20 each having two contact portions 16 and a conductor 18 for connecting said two contact portions 16 to be in electrical continuity, a flexible printed circuit board 12 on which said plurality of contact conductors 20 are arranged so that said contact portions 16 can be connected to contacts of connecting objects, said flexible printed circuit board 12 being folded back at a predetermined position to arrange said contact portions 16 on the front and rear faces of the folded flexible printed circuit board 12, mounting means or pushing means for mounting or pushing the connector onto said connecting objects, provided on said flexible printed circuit board 12 at location except for the locations where said contact conductors 20 are provided, and an elastic member 14 arranged between said contact portions 16 on the front and rear faces of said folded flexible printed circuit board 12.

The object described above is also accomplished by the connector 101 defined in claim 2 according to the invention comprising a plurality of contact conductors 201 each having two contact portions 161 and a conductor 181 for connecting said two contact portions 161 to be in electrical continuity, a flexible printed circuit board 121 on which said plurality of contact conductors 201 are arranged so that said contact portions 161 can be connected to contacts of connecting objects, an elastic member 141 held on the side of said flexible printed circuit board 121 opposite from the side provided with said contact portions 161, and at least one pushing member 15 for pushing said flexible printed circuit board 121 toward said connecting objects or pushing said connecting objects toward said flexible printed circuit board 121.

The expression "so that said contact portions 16, 161 can be connected to contacts of connecting objects" means that the contact portions 16, 161 are provided at locations corresponding to positions of contacts provided on the connecting objects, respectively. Moreover, the term "a predetermined position" means such a position which is an arbitrary position between the two contact portions 16 of the contact conductors 20 and enables the contact portions 16 to be connected to the contacts of the connecting objects. Further, the term "at least one pushing member 15" as used herein is to be understood to mean that two pushing members 15 may be provided for the purpose of pushing the contact portions 161 on one side and the contact portions 161 on the other side of the contact conductors 201 in different directions, respectively.

In the connector 10, 101 defined in claim 3, a substantially U-shaped slit 22, 221 is provided partly surrounding each of the contact portions 16, 161 of said contact conductors 20, 201.

In the connector 10 defined in claim 4, said flexible printed circuit board 12 provided with said plurality of contact conductors 20 arranged in parallel with one another is folded back substantially along a center line of its width so that said contact portions 16 on the front and rear faces of the folded flexible printed circuit board 12 are arranged in aligned positions on the front and rear faces.

In the connector 10 defined in claim 5, all said contact conductors 20 have equal lengths between the two contact portions 16, and such contact conductors 20 are arranged in the longitudinal direction of the flexible printed circuit board 12 so that said contact portions 16 are arranged to be staggered to occupy mutually shifted positions alternately one by one so that a pitch narrower than the pitch of connector is possible.

In the connector 10 defined in claim 6, said contact conductors 20 are arranged in the longitudinal direction of the flexible printed circuit board 12 so that the contact portions 16 of said contact conductors 20 are staggered to occupy mutually shifted positions alternately one by one and the contact portions 16 of said contact conductors 20 arranged on the front and rear faces of the folded flexible printed circuit board 12 are arranged in aligned positions on the front and rear faces.

In the connector 10 defined in claim 7, the contact portions 16 of the two adjacent contact conductors 20 are arranged in the same straight line in the width direction of the flexible printed circuit board 12, and said contact portions 16 on the front and rear faces of the folded flexible printed circuit board 12 are arranged in grid shapes, respectively, and are arranged in aligned positions on the front and rear faces.

In the connector 10 defined in claim 8, the contact portions 16 of the three adjacent contact conductors 20 are arranged in the same straight line in the width direction of the flexible printed circuit board 12, and said contact portions 16 on the front and rear faces of the folded flexible printed circuit board 12 are arranged in grid shapes, respectively, and are arranged in aligned positions on the front and rear faces.

In the connector 10 defined in claim 9, the contact portions 16 of the four or more adjacent contact conductors 20 are arranged in the same straight line in the width direction of the flexible printed circuit board 12, and said contact portions 16 on the front and rear faces of the folded flexible printed circuit board 12 are arranged in grid shapes, respectively, and in aligned positions on the front and rear faces.

In the connector 10 defined in claim 10, a part or parts of said flexible printed circuit board 12 are folded back at predetermined positions.

The expression "part or parts" is here understood as signifying the fact that only one part or two or more parts of a flexible printed circuit board may be folded back and may be suitably designed depending on positions of contacts of connecting objects.

In the connector 101 defined in claim 11, said elastic member 141 is varied in shape in order to make uniform the contact pressure of said flexible printed circuit board 121 to said connecting objects or the contact pressure of said connecting objects to said flexible printed circuit board 121.

In the connector 101 defined in claim 12, a plurality of said contact conductors 201 are arranged in parallel with one another In the connector 101 defined in claim 13, said contact conductors 201 have equal lengths between the two contact portions 161, and such contact conductors 201 are arranged in the longitudinal direction of the flexible printed circuit board 121 so that said contact portions 161 are arranged to be staggered to occupy mutually shifted positions alternately one by one so that a pitch narrower than the pitch of connector is possible.

In the connector 101 as set forth in claim 14, the two adjacent contact conductors 201 have different lengths between the two contact portions 161, and such contact conductors 201 are arranged in the longitudinal direction of the flexible printed circuit board 121 so that said contact portions 161 are arranged to be staggered to occupy mutually shifted positions alternately one by one.

In the connector 101 defined in claim 15, the contact portions 161 of a plurality of said contact conductors 201 are arranged in the same straight line in the width direction of the flexible printed circuit board 121, and said contact portions 161 on one side and on the other side are arranged in grid shapes, respectively.

In the connector 101 defined in claim 16, one or more of parts of said flexible printed circuit board 121 are provided with a plurality of the contact conductors 201 at predetermined positions.

The expression "a part or parts" as used herein is to be understood to mean that only one part or two or more parts of a flexible printed circuit board 121 may be provided with the contact conductors, and locations where the contact conductors are arranged on the flexible printed circuit board may be suitably designed correspondingly to locations of contacts of the connecting objects.

The object of the invention described above is achieved by the pushing jig 40 defined in claim 17 comprising a base material 42, a plurality of pushing portions 46 provided on said base material 42 integrally therewith or separately therefrom to be pushed against connecting objects, an elastic member 44 held on the side of said base material 42 opposite from said pushing portions 46, and at least one pushing member 45 for pushing said base material 42 to said connecting objects or pushing said connecting objects to said base material 42.

The term "at least one pushing member 15" as used herein is to be understood to mean that two pushing members 15 may be provided according to the locations where said pushing portions 46 are arranged.

In the pushing jig 40 defined in claim 18, a substantially U-shaped slit 52 is provided partly surrounding each of said pushing portions 46.

In the pushing jig 40 defined in claim 19, said U-shaped slits 52 are arranged to be directed so that vectors of forces applied to said pushing portions 46 become zero at the center of said pushing jig 40 upon said pushing jig 40 being pushed to said connecting objects.

In the pushing jig 40 defined in claims 20, said elastic member 44 is varied in shape in order to make uniform the contact pressure of said base material 42 against said connecting objects or the contact pressure of said connecting objects against said base material 42.

In the pushing jig 40 defined in claim 21, said pushing portions 46 are arranged in the longitudinal direction of the base member 42 to be staggered to occupy mutually shifted positions alternately one by one.

In the pushing jig 40 defined in claim 22, the plurality of said pushing portions 46 are arranged in a grid shape.

In the pushing jig 40 defined in claim 23, a part or parts of said base material 42 are provided with a plurality of said pushing portions 46 at predetermined positions.

The expression "a part or parts" is here understood as signifying the fact that only one part of a base material 42 may be provided with the pushing portions 46 or two or more parts of a base material 42 may be provided with the pushing portions 46, and locations where the pushing portions 46 are provided may be arbitrarily suitably designed according to positions of contacts of connecting objects.

As can be seen from the above description, the connector 10, 101 and the pushing jig 40 can bring about the following significant functions and effects. (1) According to the invention defined in claim 1, the connector 10 comprises a plurality of contact conductors 20 each having two contact portions 16 and a conductor 18 for connecting said two contact portions 16 to be in electrical continuity, a flexible printed circuit board 12 on which said plurality of contact conductors 20 are arranged so that said contact portions 16 can be connected to contacts of connecting objects, said flexible printed circuit board 12 being folded back at a predetermined position to arrange said contact portions 16 on the front and rear faces of the folded flexible printed circuit board 12, mounting means or pushing means for mounting or pushing the connector onto said connecting objects, provided on said flexible printed circuit board 12 at location except for the locations where said contact conductors 20 are provided, and an elastic member 14 arranged between said contact portions 16 on the front and rear faces of said folded flexible printed circuit board 12. Accordingly, a reduced overall height or reduced distance between substrates 60 to be connected is possible, and a narrower pitch can be realized. A stable connection can be obtained even with repeated connections.

(2) According to the invention defined in claim 2, the connector 101 comprises a plurality of contact conductors 201 each having two contact portions 161 and a conductor 181 for connecting said two contact portions 161 to be in electrical continuity, a flexible printed circuit board 121 on which said plurality of contact conductors 201 are arranged so that said contact portions 161 can be connected to contacts of connecting objects, an elastic member 141 held on the side of said flexible printed circuit board 121 opposite from the side provided with said contact portions 161, and at least one pushing member 15 for pushing said flexible printed circuit board 121 toward said connecting objects or pushing said connecting objects toward said flexible printed circuit board 121. Consequently, a reduced overall height or reduced distance between substrates 601 to be connected is possible, and a narrower pitch can be realized. A stable connection can be obtained even with repeated connections.

(3) In the connector 10, 101 defined in claim 3, a substantially U-shaped slit 22, 221 is provided partly surrounding each of the contact portions 16, 161 of said contact conductors 20, 201. Therefore, a stable connection can be obtained even with variations in height of the contact portions 16, 161.

(4) In the connector 10 defined in claim 4, said flexible printed circuit board 12 provided with said plurality of contact conductors 20 arranged in parallel with one another is folded back substantially along a center line of its width so that said contact portions 16 on the front and rear faces of the folded flexible printed circuit board 12 are arranged in aligned positions on the front and rear faces. Accordingly, a reduced overall height or reduced distance between substrates 60 to be connected is possible, and a narrower pitch can be realized. A stable connection can be obtained even with repeated connections.

(5) In the connector 10 defined in claim 5, all said contact conductors 20 have equal lengths between the two contact portions 16, and such contact conductors 20 are arranged in the longitudinal direction of the flexible printed circuit board 12 so that said contact portions 16 are arranged to be staggered to occupy mutually shifted positions alternately one by one. Therefore, a pitch narrower than the pitch of the connector in claim 4 is possible, and a higher density can also be realized. As the distances between the contact portions are equal, resistances become the same so that skews (time differences of a signals through the paths) become also the same, thereby obtaining a stable connection.

(6) In the connector 10 defined in claim 6, said contact conductors 20 are arranged in the longitudinal direction of the flexible printed circuit board 12 so that the contact portions 16 of said contact conductors 20 are staggered to occupy mutually shifted positions alternately one by one and the contact portions 16 of said contact conductors 20 arranged on the front and rear faces of the folded flexible printed circuit board 12 are arranged in aligned positions on the front and rear faces. Accordingly, a pitch narrower than the pitch of the connector in claim 4 is possible, and a higher density and stable connection can also be realized.

(7) In the connector 10 defined in claim 7, the contact portions 16 of the two adjacent contact conductors 20 are arranged in the same straight line in the width direction of the flexible printed circuit board 12, and said contact portions 16 on the front and rear faces of the folded flexible printed circuit board 12 are arranged in grid shapes, respectively, and are arranged in aligned positions on the front and rear faces. Therefore, a pitch narrower than the pitch of the connector in claim 4 is possible, and a higher density and stable connection can also be realized.

(8) In the connector 10 defined in claim 8, the contact portions 16 of the three adjacent contact conductors 20 are arranged in the same straight line in the width direction of the flexible printed circuit board 12, and said contact portions 16 on the front and rear faces of the folded flexible printed circuit board 12 are arranged in grid shapes, respectively, and are arranged in aligned positions on the front and rear faces. Consequently, a pitch narrower than the pitch of the connector in claim 7 is possible, and a higher density and stable connection can also be realized.

(9) In the connector 10 defined in claim 9, the contact portions 16 of the four or more adjacent contact conductors 20 are arranged in the same straight line in the width direction of the flexible printed circuit board 12, and said contact portions 16 on the front and rear faces of the folded flexible printed circuit board 12 are arranged in grid shapes, respectively, and in aligned positions on the front and rear faces. Therefore, a pitch narrower than the pitch of the connector in claim 8 is possible, and a higher density and stable connection can also be realized.

(10) In the connector 10 defined in claim 10, a part or parts of said flexible printed circuit board 12 are folded back at predetermined positions. Therefore, stable connection can be obtained in connection with connecting objects at particular portions.

(11) In the connector 101 defined in claim 11, said elastic member 141 is varied in shape in order to make uniform the contact pressure of said flexible printed circuit board 121 to said connecting objects or the contact pressure of said connecting objects to said flexible printed circuit board 121. Therefore, stable connection can be realized.

(12) In the connector 101 defined in claim 12, a plurality of said contact conductors 201 are arranged in parallel with one another. Consequently, a reduced overall height or reduced distance between substrates 601 to be connected is possible, and a narrower pitch can be realized. A stable connection can be obtained even with repeated connections.

(13) In the connector 101 defined in claim 13, all said contact conductors 201 have equal lengths between the two contact portions 161, and such contact conductors 201 are arranged in the longitudinal direction of the flexible printed circuit board 121 so that said contact portions 161 are arranged to be staggered to occupy mutually shifted positions alternately one by one. As the distances between the contact portions are equal, resistances become the same so that skews (time differences of a signals through the paths) become also the same, thereby obtaining a stable connection.

(14) In the connector 101 defined in claim 14, the two adjacent contact conductors 201 have different lengths between the two contact portions 161, and such contact conductors 201 are arranged in the longitudinal direction of the flexible printed circuit board 121 so that said contact portions 161 are arranged to be staggered to occupy mutually shifted positions alternately one by one. Therefore, a pitch narrower than the pitch of the connector in claim 12 is possible, and a higher density and stable connection can also be realized.

(15) In the connector 101 defined in claim 15, the contact portions 161 of a plurality of said contact conductors 201 are arranged in the same straight line in the width direction of the flexible printed circuit board 121, and said contact portions 161 on one side and on the other side are arranged in grid shapes, respectively. Accordingly, a pitch narrower than the pitch of the connector in claim 14 is possible, and a higher density and stable connection can also be realized.

(16) In the connector 101 defined in claim 16, a part or parts of said flexible printed circuit board 121 are provided with a plurality of the contact conductors 201 at predetermined positions. Therefore, stable connection can be obtained in connection with connecting objects at particular portions.

(17) According to the invention defined in claim 17, a pushing jig 40 comprises a base material 42, a plurality of pushing portions 46 provided on said base material 42 integrally therewith or separately therefrom to be pushed against connecting objects, an elastic member 44 held on the side of said base material 42 opposite from said pushing portions 46, and at least one pushing member 45 for pushing said base material 42 to said connecting objects or pushing said connecting objects to said base material 42. Consequently, a reduced overall height or reduced distance between substrates 602 to be connected is possible, and a narrower pitch can be realized. A stable connection can be obtained even with repeated connections.

(18) In the pushing jig 40 defined in claim 18, a substantially U-shaped slit 52 is provided partly surrounding each of said pushing portions 46. Therefore, a stable connection can be obtained even with variations in height of the contact portions 46.

(19) In the pushing jig 40 defined in claim 19, said U-shaped slits 52 are arranged to be directed so that vectors of forces applied to said pushing portions 46 become zero at the center of said pushing jig 40 upon said pushing jig 40 being pushed to said connecting objects. Accordingly, stable pushing is possible.

(20) In the pushing jig 40 defined in claim 20, said elastic member 44 is varied in shape in order to make uniform the contact pressure of said base material 42 against said connecting objects or the contact pressure of said connecting objects against said base material 42. Therefore, stable contact pressure can be obtained.

(21) In the pushing jig 40 defined in claim 21, said pushing portions 46 are arranged in the longitudinal direction of the base member 42 to be staggered to occupy mutually shifted positions alternately one by one. Accordingly, a pitch narrower than the pitch of the pushing jig 40 in claim 17 is possible, and a higher density and stable connection can also be realized.

(22) In the pushing jig 40 defined in claim 22, the plurality of said pushing portions 46 are arranged in a grid shape. Therefore, a pitch narrower than the pitch of the pushing jig 40 in claim 20 is possible, and a higher density and stable connection can also be realized.

(23) In the pushing jig 40 defined in claim 23, a part or parts of said base material 42 are provided with a plurality of said pushing portions 46 at predetermined positions. Therefore, stable connection can be obtained in connection with connecting objects at particular portions.

The invention will be more fully understood by referring to the following detailed specification and claims taken in connection with the appended drawings.

DESCRIPTION OF THE PREFERRED EMBODIMENTS

Figure 1A:
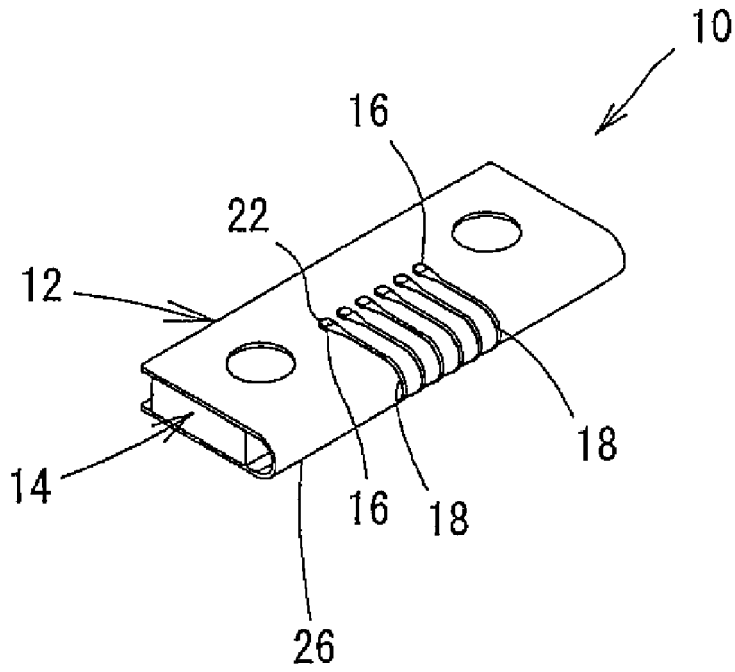
FIG. 1A is a perspective view of the connector folded back, viewed from the side of the fold line toward the front face.
Figure 1B:
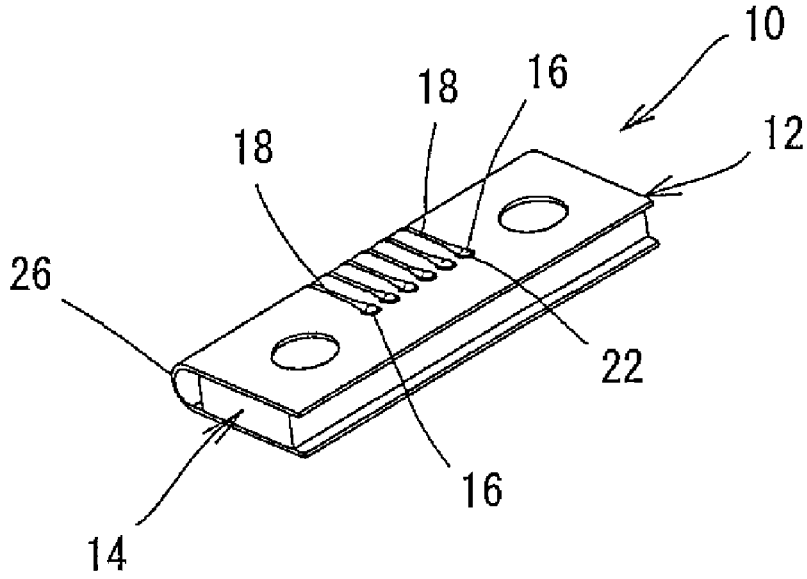
FIG. 1B is a perspective view of the connector folded back, viewed from the opposite side of the fold line toward the rear face.
Figure 2A:
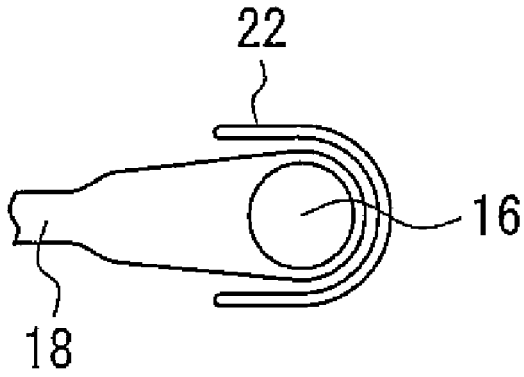
FIG. 2A is a partly enlarged view of a contact portion.
Figure 2B:
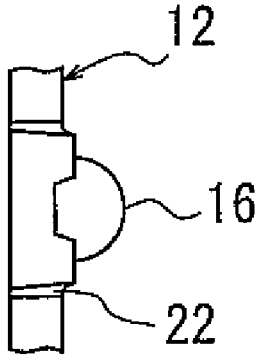
FIG. 2B is a sectional view of the contact portion taken along its center.
Figure 3A:
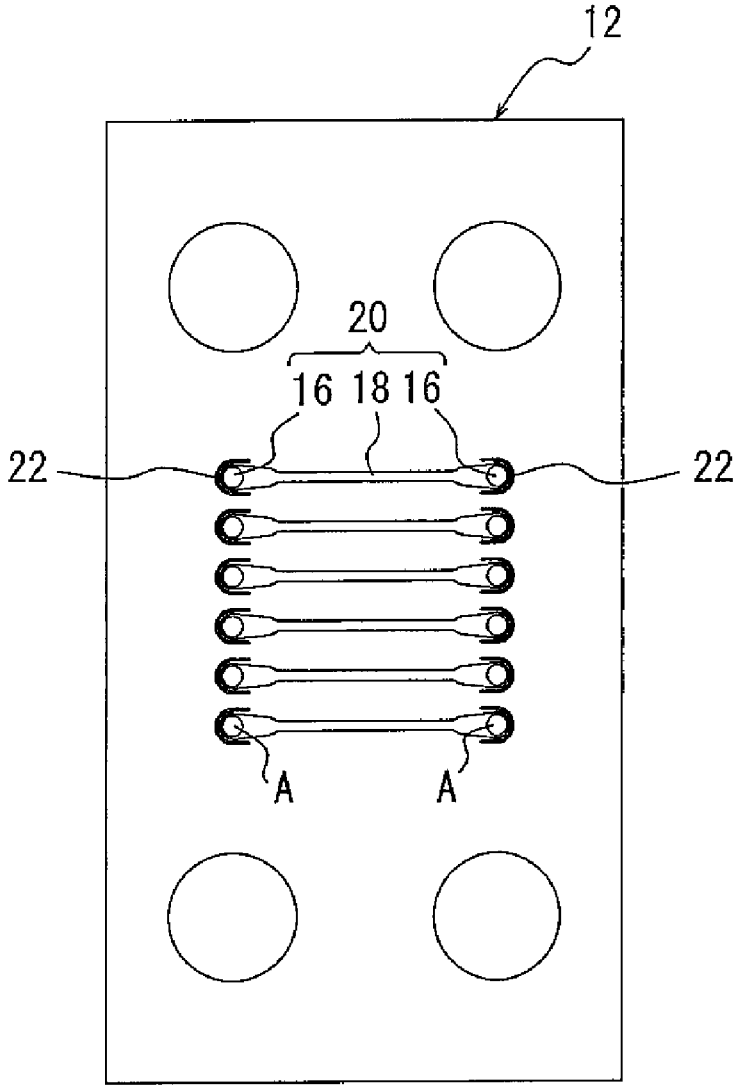
FIG. 3A is a plan view of a flexible printed circuit board having contact conductors arranged in a row viewed from contact portions.
Figure 3B:
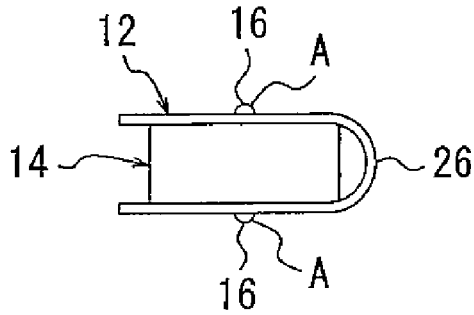
FIG. 3B is a side view of the circuit board shown in FIG. 3A folded back at its center.
Figure 4A:
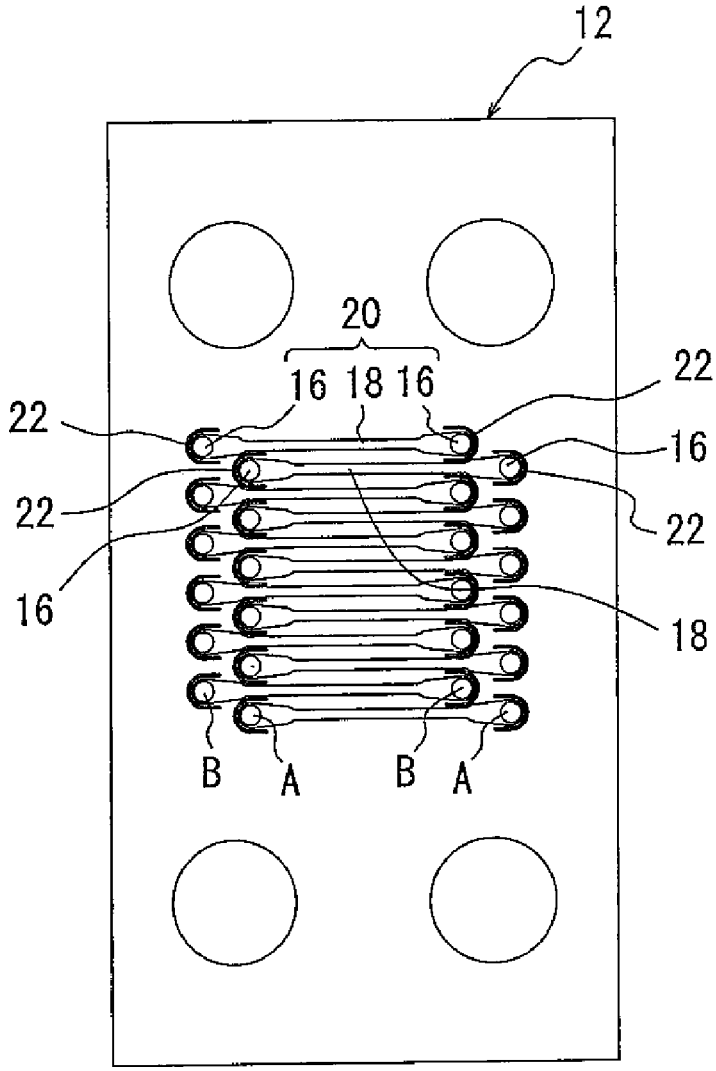
FIG. 4A is a plan view of a flexible printed circuit board having contact conductors equal in length arranged in two rows whose contact portions arranged to be staggered, viewed from the side of the contact portions.
Figure 4B:
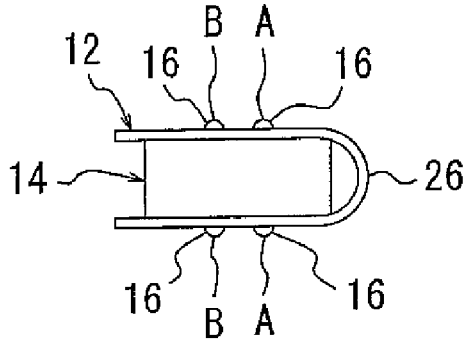
FIG. 4B is a side view of the circuit board shown in FIG. 4A folded back at its center.
Figure 5A:
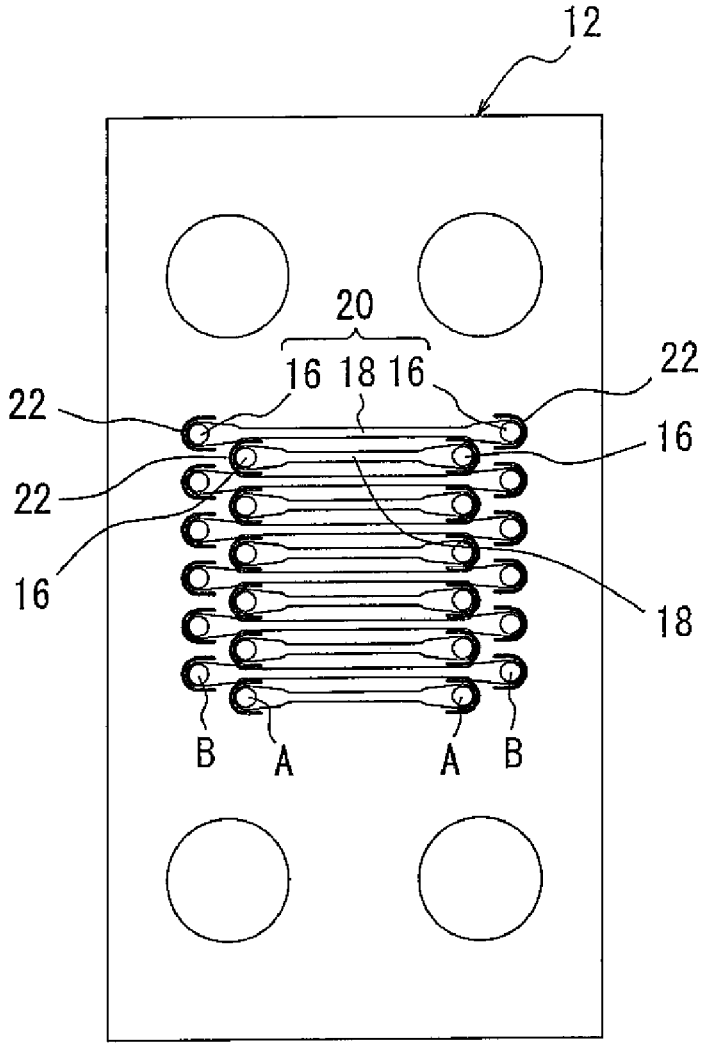
FIG. 5A is a plan view of a flexile printed circuit board having contact conductors whose contact portions are arranged in the longitudinal direction to be staggered to occupy mutually shifted positions alternately one by one, and the contact portions of the contact conductors on the front and rear faces of the circuit board are arranged in aligned positions on the front and rear faces.
Figure 5B:
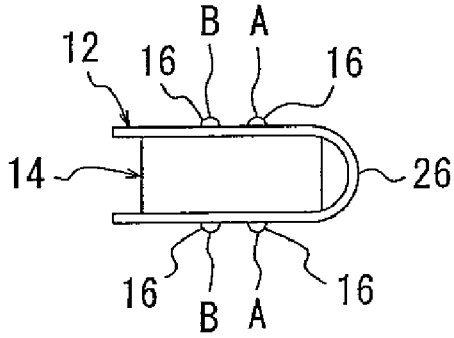
FIG. 5B is a side view of the circuit board shown in FIG. 5A folded back at its center.
Figure 6A:
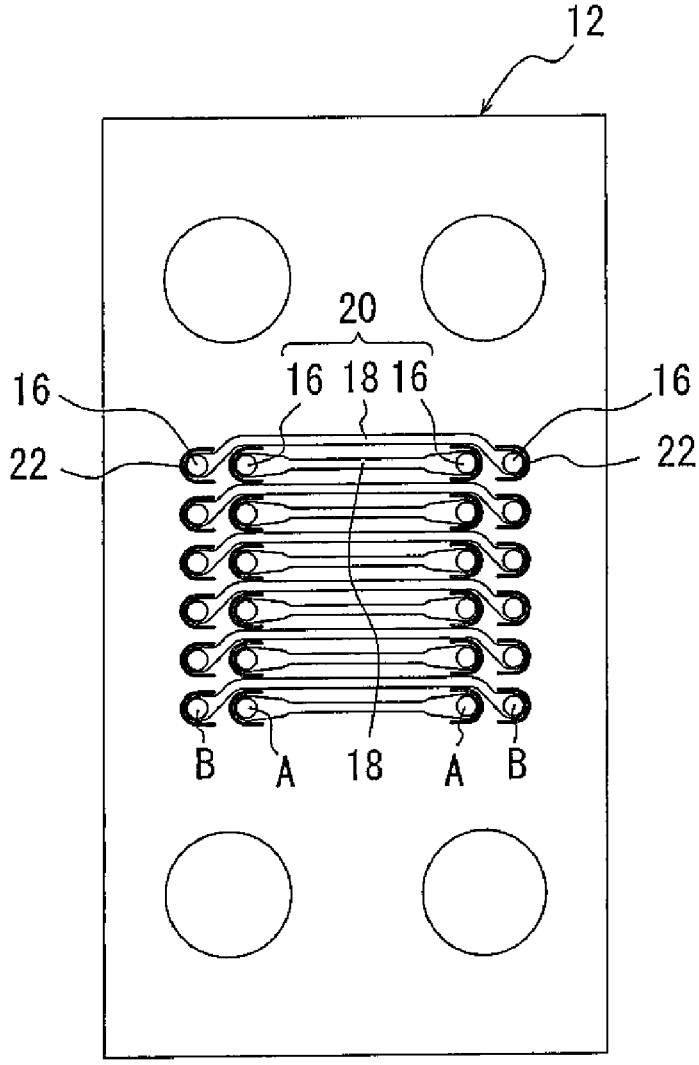
FIG. 6A is a plan view of a flexible printed circuit board having contact conductors whose contact portions of two adjacent contact conductors are arranged in the same straight line in the width direction and whose contact portions on the front and rear faces are arranged in grid shapes, respectively, and the contact portions of the contact conductors on the front and rear faces of the circuit board are arranged in aligned positions on the front and rear faces.
Figure 6B:
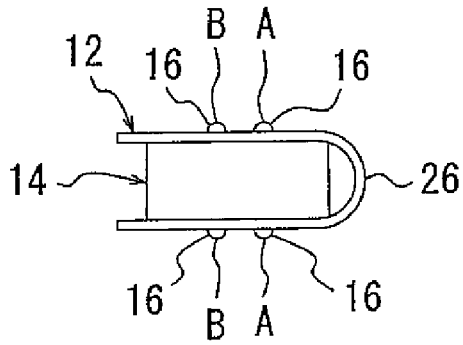
FIG. 6B is a side view of the circuit board shown in FIG. 6A folded back at its center.
Figure 7A:
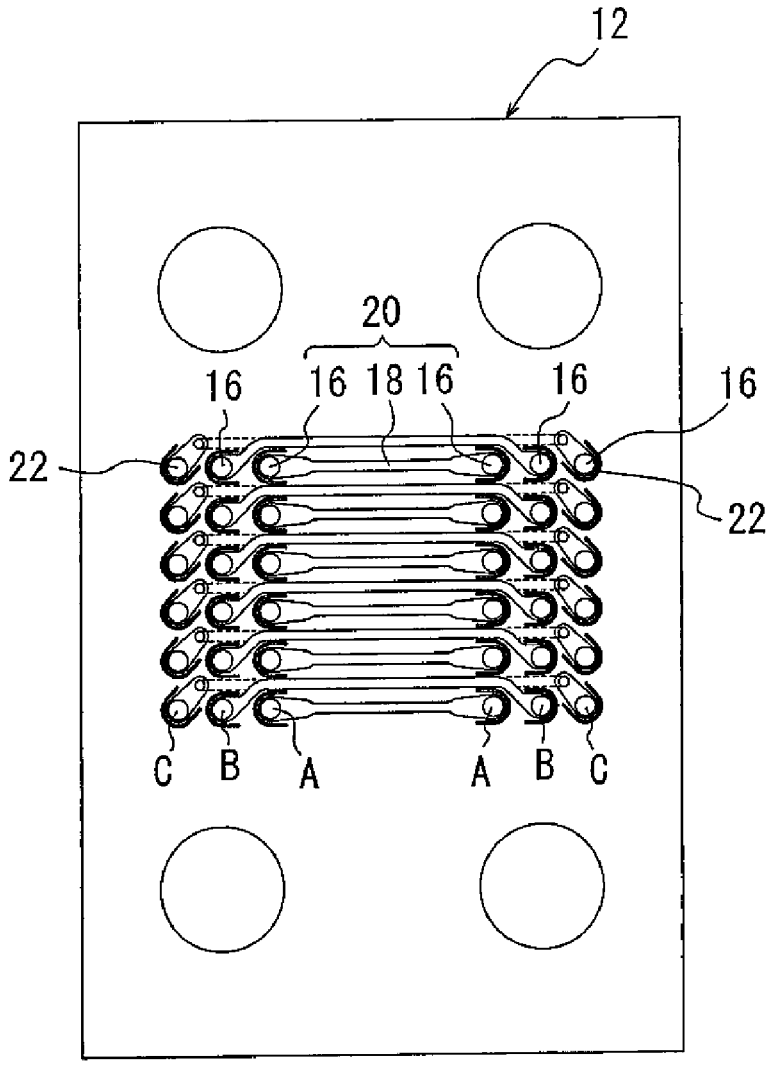
FIG. 7A is a plan view of a flexible printed circuit board having contact conductors whose contact portions of three adjacent contact conductors are arranged in the same straight line in the width direction and whose contact portions on the front and rear faces are arranged in grid shapes, respectively, and are arranged in aligned positions on the front and rear faces.
Figure 7B:
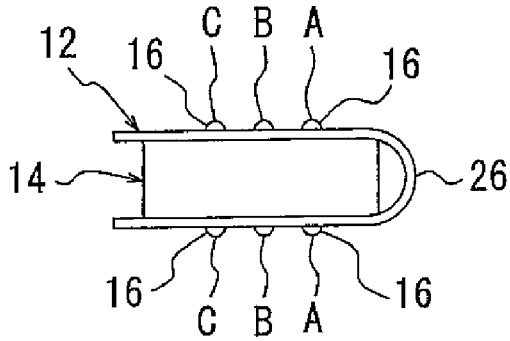
FIG. 7B is a side view of the circuit board shown in FIG. 7A folded back at its center.
Figure 8:
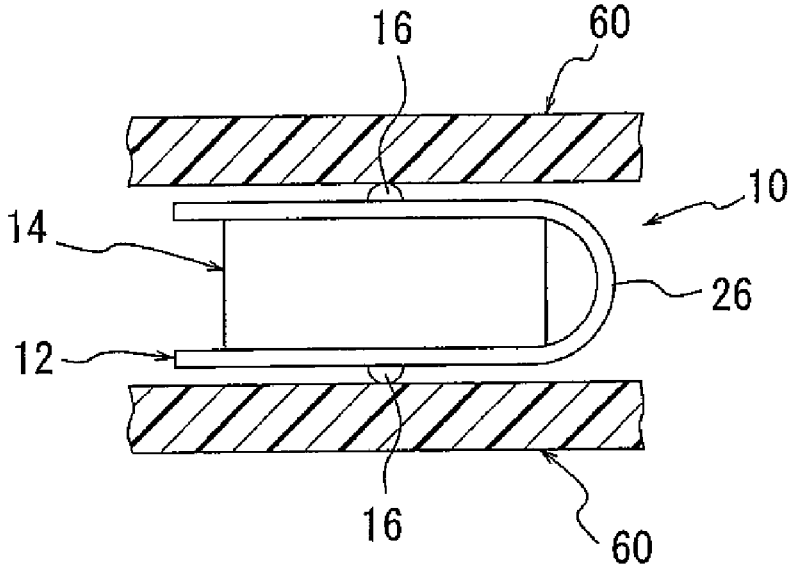
FIG. 8 is a sectional view of the connector according to the invention arranged between substrates and connected to these substrates.
Figure 9:
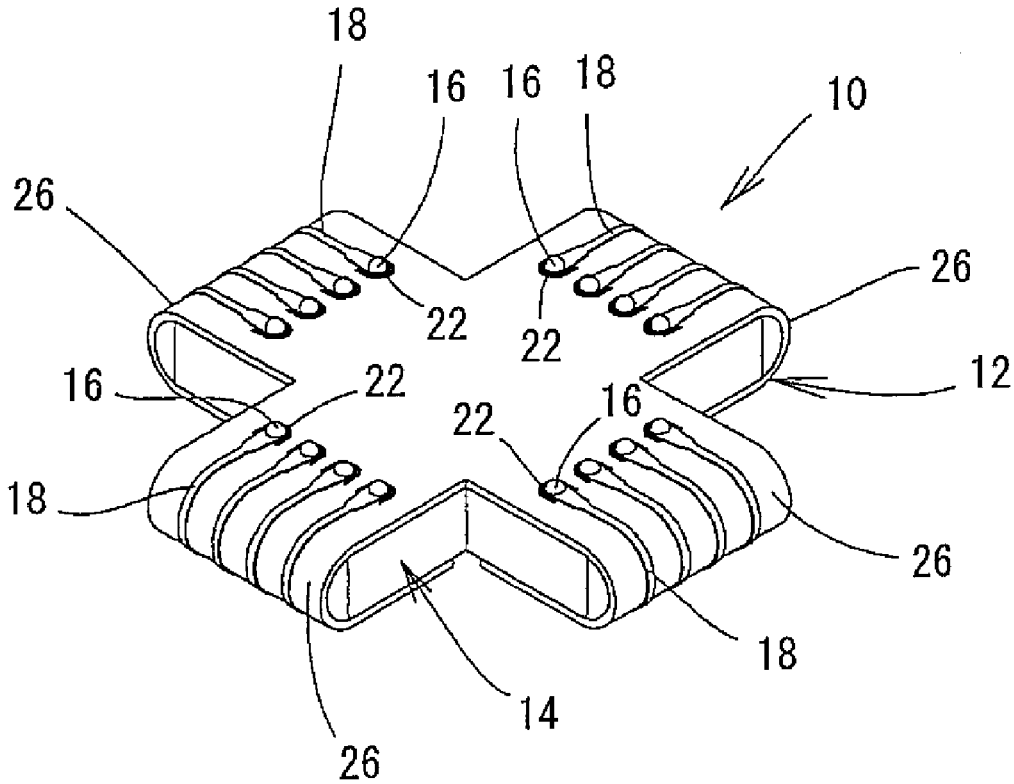
FIG. 9 is a perspective view of a connector as another embodiment with a substantially cross-shaped flexible printed circuit board whose four parts are folded back, viewed from the front face of the circuit board.

One embodiment of the connector according to the invention defined in claims 1 and 3 to 10 will be explained with reference to FIGS. 1A to 8. FIG. 1A is a perspective view of the connector folded back, viewed from the side of the fold line toward the front face, while FIG. 1B is a perspective view of the connector folded back, viewed from the opposite side of the fold line toward the rear face. FIG. 2A is a partly enlarged view of a contact portion, while FIG. 2B is a sectional view of the contact portion taken along its center. FIG. 3A is a plan view of a flexible printed circuit board having contact conductors arranged in a row viewed from contact portions, and FIG. 4A is a plan view of a flexible printed circuit board having contact conductors equal in length arranged in two rows whose contact portions arranged to be staggered, viewed from the side of the contact portions. FIG. 5A is a plan view of a flexile printed circuit board having contact conductors whose contact portions are arranged in the longitudinal direction to be staggered to occupy mutually shifted positions alternately one by one, and the contact portions of the contact conductors on the front and rear faces of the circuit board are arranged in aligned positions on the front and rear faces. FIG. 6A is a plan view of a flexible printed circuit board having contact conductors whose contact portions of two adjacent contact conductors are arranged in the same straight line in the width direction and whose contact portions on the front and rear faces are arranged in grid shapes, respectively, and the contact portions of the contact conductors on the front and rear faces of the circuit board are arranged in aligned positions on the front and rear faces. FIG. 7A is a plan view of a flexible printed circuit board having contact conductors whose contact portions of three adjacent contact conductors are arranged in the same straight line in the width direction and whose contact portions on the front and rear faces are arranged in grid shapes, respectively, and are arranged in aligned positions on the front and rear faces. FIG. 8 is a sectional view of the connector according to the invention arranged between substrates and connected to these substrates. FIG. 9 is a perspective view of a connector as another embodiment with a substantially cross-shaped flexible printed circuit board whose four parts are folded back, viewed from the front face of the circuit board. FIGS. 3B, 4B, 5B, 6B and 7B are side views illustrating the flexible printed circuit boards folded back at the center as in FIGS. 3A to 7A, respectively.

The connector 10 according to the invention mainly comprises a flexible printed circuit board 12 and an elastic member 14.

First of all, said flexible printed circuit board 12 will be explained. Said flexible printed circuit board 12 at least includes a plurality of contact portions 16 to contact connecting objects, and holding or pushing means for mounting the circuit board 12 on the connecting objects. The shape of the contact portions may be suitably designed so as to be most suitable for the connecting objects. The term "most suitable for" used herein is to be understood as signifying, for example, a hemispherical protrusion if the mating shape is flat as in the illustrated embodiment, or a flat shape or a protrusion like a mountain if the mating shape is a hemispherical protrusion. Moreover, the circuit board is formed with a U-shaped slit 22 partly surrounding each of said contact portions 16. By forming the U-shaped slit 22, the contact portion 16 is supported by a cantilever so that upon contacting a mating connecting object, the contact portion 16 is elastically deformed or displaced, thereby accommodating the irregularity or variation in height of the contact portions 16. For such a purpose, the elastic member 14 is embraced between contact portions 16 of the front and rear faces of the folded flexible printed circuit board 12 so as to permit the deformation or displacement of the contact portions. The size of the elastic member 14 is about one half of that of the circuit board prior to being folded back, and the thickness of the elastic member 14 may be suitably designed in consideration of the displacement of the contact portions 16 and the overall height of the connector to be reduced.

The connector 10 according to the invention is for connecting two connecting objects (for example, connecting two substrates 60, connecting a substrate 60 and a flexible printed circuit board, connecting a substrate 60 and flexible printed circuit board cables, and connecting an electronic appliance and a substrate 60). Therefore, the two contact portions 16 provided on said flexible printed circuit board are connected in continuity with each other through a conductor 18 to form one contact conductor (having the two contact portions 16 and the conductor 18 bringing the two contact portions 16 into continuity with each other). A plurality of said contact conductors 20 are arranged in a manner that the contact portions 16 are connected to contacts of connecting objects, respectively. Said flexible printed circuit board 12 is folded back at its predetermined position so that said contact portions 16 are arranged on the front and rear faces of the folded circuit board 12.

The expression "in a manner that contact portions 16 are connected to contacts of connecting objects" means that the contact portions 16 are provided at locations corresponding to positions of contacts provided on the connecting objects, respectively. Moreover, the term "predetermined position" means such a position which is an arbitrary position between the two contact portions 16 of the contact conductors 20 and enables the contact portions 16 to be connected to the contacts of the connecting objects.

One embodiment of the connector is shown in FIGS. 1A and 1B. Namely, the flexible printed circuit board 12 is provided with a plurality of the contact conductors 20 arranged in parallel with one another and is folded back along its center line of the width of the board, that is, its longitudinal line dividing the board into two halves so that said contact portions 16 are arranged in aligned positions on the front and rear faces of the folded circuit board. Said contact portions 16 arranged on the front and rear faces of the circuit board are connected to the contacts of said connecting objects, respectively. The arrangement of the contact conductors 20 will be explained with reference to the drawings hereafter.

FIG. 3A illustrates a state of the contact conductors 20 arranged in a row in the longitudinal direction of a flexible printed circuit board 12. In other words, said contact conductors 20 each having the two contact portions 16 and the conductor 18 causing the two contact portions 16 to be in electrically continuity with each other are arranged in a row with a constant pitch in the longitudinal direction of the flexible printed circuit board. The spacing between the adjacent contact conductors 20 will be determined by the machining technique for the U-shaped slits and the size (height) of said contact portions 16, and can be of the order of 300 μm at the minimum. In the case that the flexible printed circuit board 12 is folded back substantially along the center, the contact portions 16 on the front and rear faces of the circuit board are arranged in aligned positions on the front and rear faces as shown in FIG. 3B.

FIG. 4A illustrates a state that the contact conductors 20 have the same length (the distances between A and A of the contact portions 16 and between B and B of the contact portions 16 are equal to each other) and are arranged in two rows so that the contact portions 16 are staggered to occupy mutually shifted positions alternately one by one. The two adjacent and staggered contact conductors 20 form a pair of contact conductors, and the pairs of contact conductors 20 are arranged in one row with a constant pitch in the longitudinal direction of the flexible printed circuit board. The spacing between the adjacent pairs of the contact conductors 20 will be determined by the machining technique for the U-shaped slits and the size (height) of said contact portions 16, and can be of the order of 300 μm at the minimum. The distances between the contact portions 16 of said contact conductors 20 are made to be equal so that resistances become equal and skews (time differences of a plurality of signals through respective paths) become equal. In other words, when said flexible printed circuit board 12 is folded back substantially at its center, the contact portions 16 on the front and rear faces of the circuit board 12 are staggered relative to each other on the front and rear faces as shown in FIG. 4B.

FIG. 5A illustrates a state that the contact portions 16 of said contact conductors 20 are arranged in the longitudinal direction of the flexible printed circuit board to be staggered to occupy mutually shifted positions alternately one by one, and the contact portions 16 of said contact conductors 20 arranged on the front and rear faces of the folded flexible printed circuit board are arranged in aligned positions on the front and rear faces. The two adjacent contact conductors 20 form a pair of contact conductors, and the pairs of contact conductors 20 are arranged in one row with a constant pitch in the longitudinal direction of the flexible printed circuit board. In other words, when the flexible printed circuit board 12 is folded back at its center, the contact portions 16 of said conductors 20 arranged on the front and rear faces of the folded flexile printed circuit board are arranged in aligned positions on the front and rear faces as shown in FIG. 5B.

FIG. 6A illustrates a state that the contact portions 16 of the two adjacent contact conductors 20 are arranged in a straight line or in aligned with one another in the width direction, and the contact portions 16 on the front and rear faces are arranged in grid shapes, respectively, and the contact portions 16 of the contact conductors 20 arranged on the front and rear faces are arranged in aligned positions on the front and rear faces. The two adjacent contact conductors whose contact portions are arranged in the straight line form a pair of contact conductors 20, and the pairs of the contact conductors 20 are arranged in a row with a constant pitch in longitudinal direction. The contact portions 16 on the front and rear faces are arranged in the grid shapes, respectively. When the flexible printed circuit board is folded back substantially at its center, said contact portions 16 of the contact conductors 20 on the front and rear faces of the folded circuit board are arranged in aligned positions on the front and rear faces as shown in FIG. 6B.

FIG. 7A illustrates a state that the contact portions 16 of the three adjacent contact conductors 20 are arranged to be aligned in a straight line in the width direction, and the contact portions 16 on the front and rear faces are arranged in grid shapes, respectively, and the contact portions 16 of the contact conductors 20 arranged on the front and rear faces are arranged in aligned positions on the front and rear faces. The three adjacent contact conductors 20 whose contact portions are arranged in the straight line in the width direction form a set of contact conductors 20, and the sets of the contact conductors 20 are arranged in a row with a constant pitch in the longitudinal direction of the flexible printed circuit board. The contact portions 16 on the front and rear faces are arranged in the grid shapes, respectively. When the flexible printed circuit board 12 is folded back substantially at its center, the contact portions 16 of the contact conductors 20 on the front and rear faces of the folded circuit board are arranged in aligned positions on the front and rear faces as shown in FIG. 7B. The conductor 18 connecting the outermost contact portions 16 of the one set of contact conductors 20 is located on the rear side of the circuit board through a through-hole as shown in FIG. 7A. The conductors 18 connecting the outermost contact portions 16 are arranged on the rear side through the through-holes to achieve the narrower pitch of the connector.

While the two or three contact conductors 20 whose contact portions 16 are arranged in one straight line are explained and shown in FIG. 6A or 7A, it will be apparent that contact portions of four or more contact conductors may be arranged in one straight line. In this case, however, pitches of the adjacent contact conductors arranged on a circuit board may be suitably designed depending upon how the conductors 18 causing two contact portions 16 to be in continuity with each other are arranged.

FIG. 8 is a sectional view showing the connector 10 according to the invention connected to substrates on both the sides. In this way, the connector 10 according to the invention is, for example, by merely pushing the connector into a space between two substrates 60 or soldered to the two substrates, thereby achieving the connection of the two substrates 60.

Another embodiment of the invention will be explained with reference to FIG. 9. FIG. 9 is a perspective view of a substantially cross-shaped flexible printed circuit board whose four parts are folded back, viewed from the front face of the circuit board. Two connecting objects of a plurality of kinds can be connected by the illustrated connector whose part or parts of a flexible printed circuit board are folded back at predetermined positions, depending upon requirements and specifications of customers. The expression "part or parts" is here understood as signifying the fact that only one part or two or more parts of a flexible printed circuit board may be folded back and may be suitably designed depending on positions of contacts of connecting objects. In the illustrated embodiment, the four parts of the substantially cross-shaped circuit board are folded back so that two connecting objects are connected at four locations.

Moreover, a plurality of connectors 10 each employing a flexible printed circuit board folded back at a predetermined position or positions are used to enable plural kinds of two connecting objects to be connected, as the case may be.

The holding or pushing means will be explained. Said holding means is for fixing the connector 10 according to the invention between connecting objects (for example, between substrates 60), and may be any one so long as it can fix the connector and may be suitably designed in consideration of a reduced overall height of the connector 10 and convenient operation for fixation of the connector 10. In other words, the holding means can be thought of as pushing means for pushing the connector 10 according to the invention into a space between two connecting objects so that the connector 10 is fixed between the two connecting objects. Said pushing means may be one which pushes one or both the connecting objects against the connector 10 without holding the connector 10. For example, the connector 10 and substrates 60 may be formed with aligned holes through which bolts are extended and tightened by nuts, or snaps each including a stud or a socket may be used.

Figure 10A:
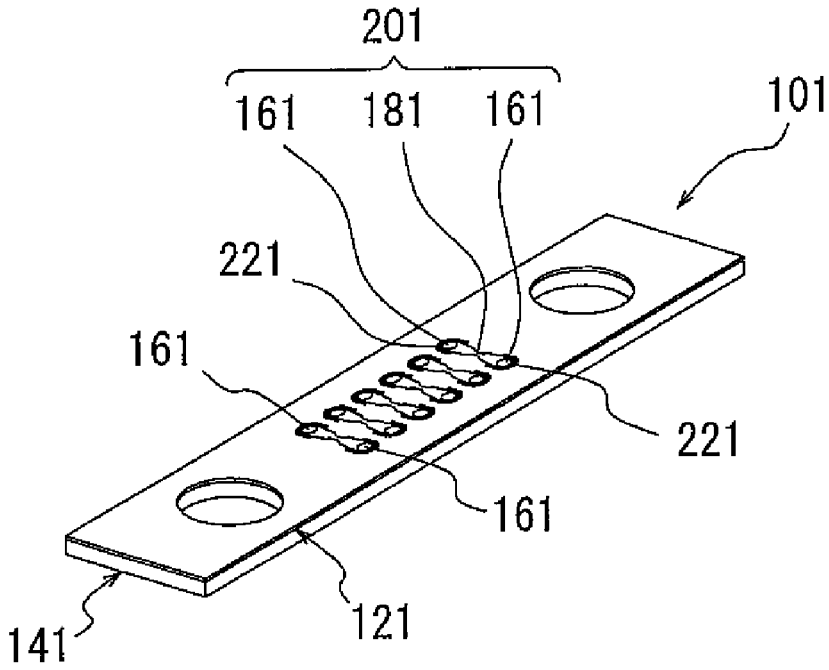
FIG. 10A is a perspective view of the connector viewed from the contacting side.
Figure 10B:
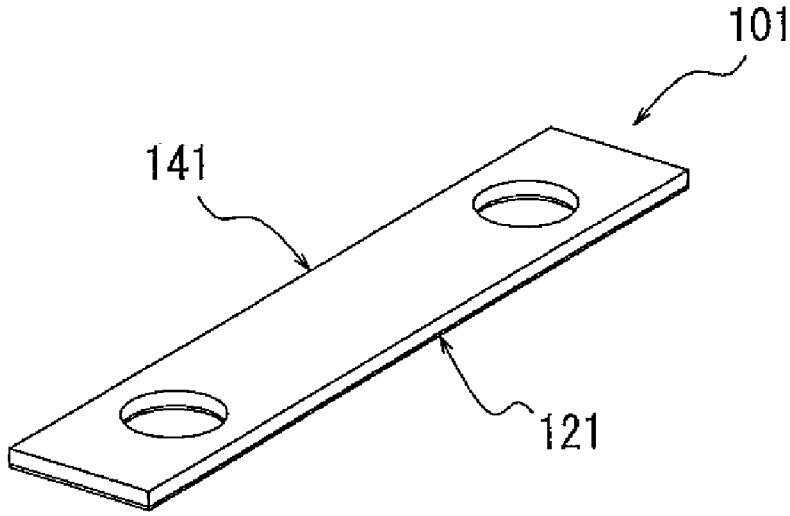
FIG. 10B is a perspective view of the connector viewed from the opposite side of the contacting side.
Figure 11A:
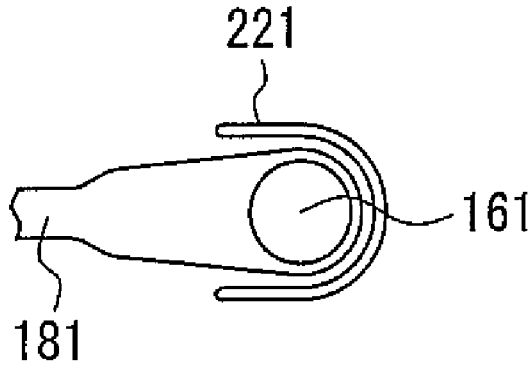
FIG. 11A is a partly enlarged view of the contact portion.
Figure 11B:
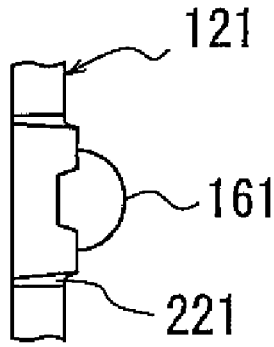
FIG. 11B is a sectional view of the contact portion taken along its center.
Figure 12A:
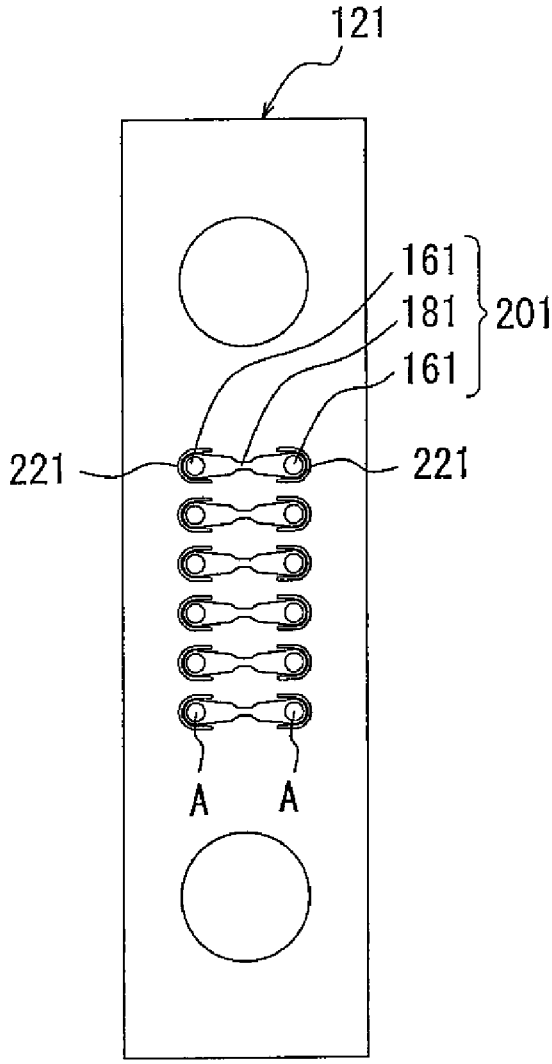
FIG. 12A is a plan view of a flexible printed circuit board having contact conductors arranged in a row viewed from the contacting side.
Figure 12B:
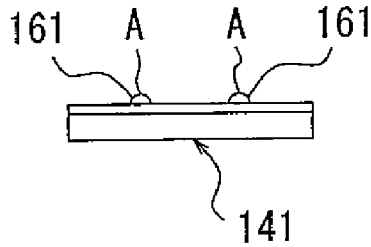
FIG. 12B is a side views illustrating the connector with contact conductors arranged as in FIG. 12A.
Figure 13A:
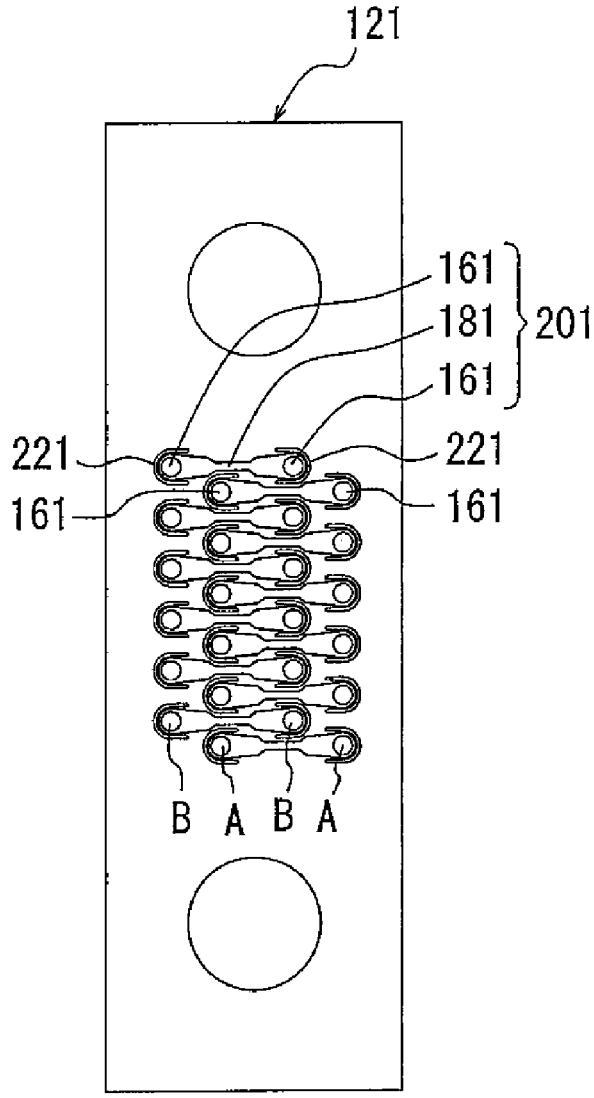
FIG. 13A is a plan view of a flexible printed circuit board having contact conductors arranged in a plurality of rows and their lengths are equal and whose contact portions are arranged to be staggered, viewed from the contacting side.
Figure 13B:
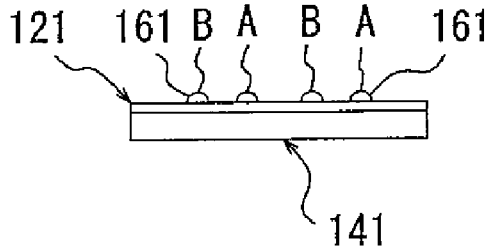
FIG. 13B is a side views illustrating the connector with contact conductors arranged as in FIG. 13A.
Figure 14A:
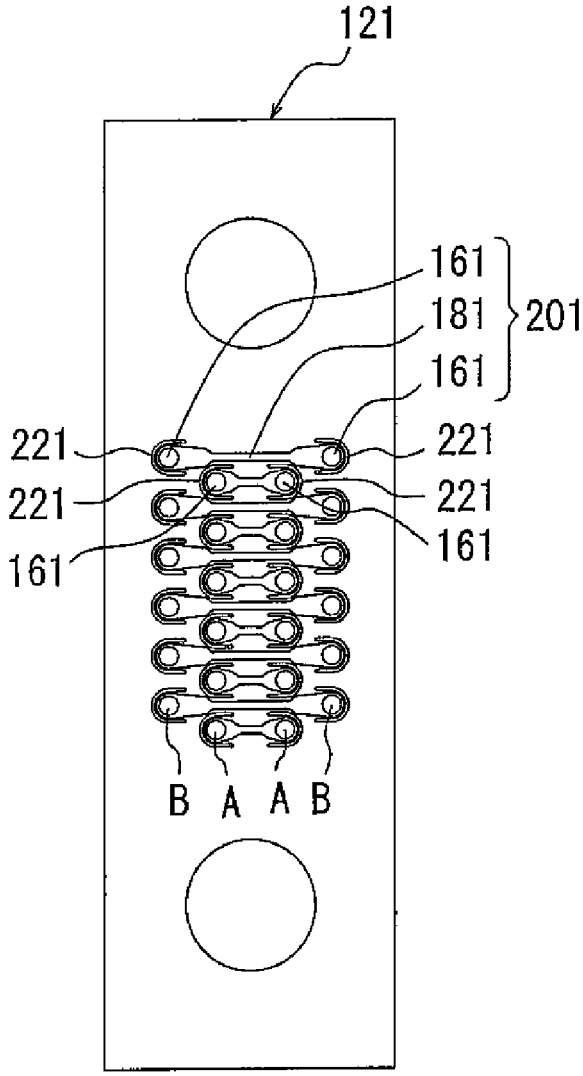
FIG. 14A is a plan view of a flexible printed circuit board having contact conductors arranged in a plurality of rows and whose contact portions are arranged in the longitudinal direction to be staggered to occupy mutually shifted positions alternately one by one.
Figure 14B:
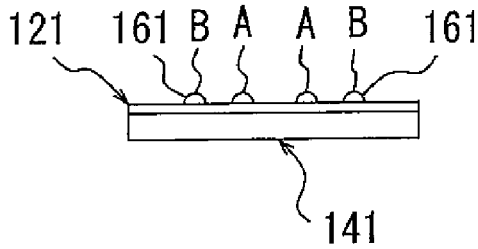
FIG. 14B is a side views illustrating the connector with contact conductors arranged as in FIG. 14A.
Figure 15A:
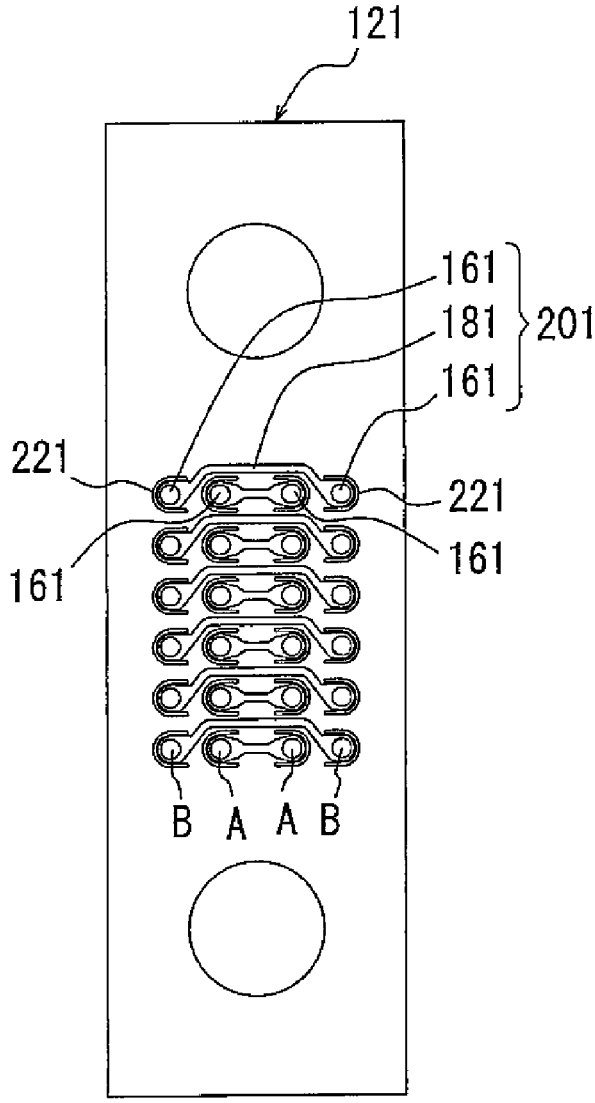
FIG. 15A is a plan view of a flexible printed circuit board having contact conductors whose contact portions of two adjacent contact conductors are arranged in a straight line in the width direction, and contact portions on one side and the other side are arranged in grid shapes, respectively.
Figure 15B:
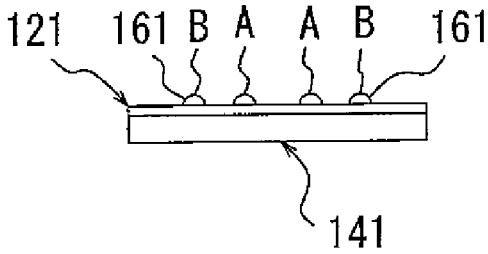
FIG. 15B is a side views illustrating the connector with contact conductors arranged as in FIG. 15A.
Figure 16A:
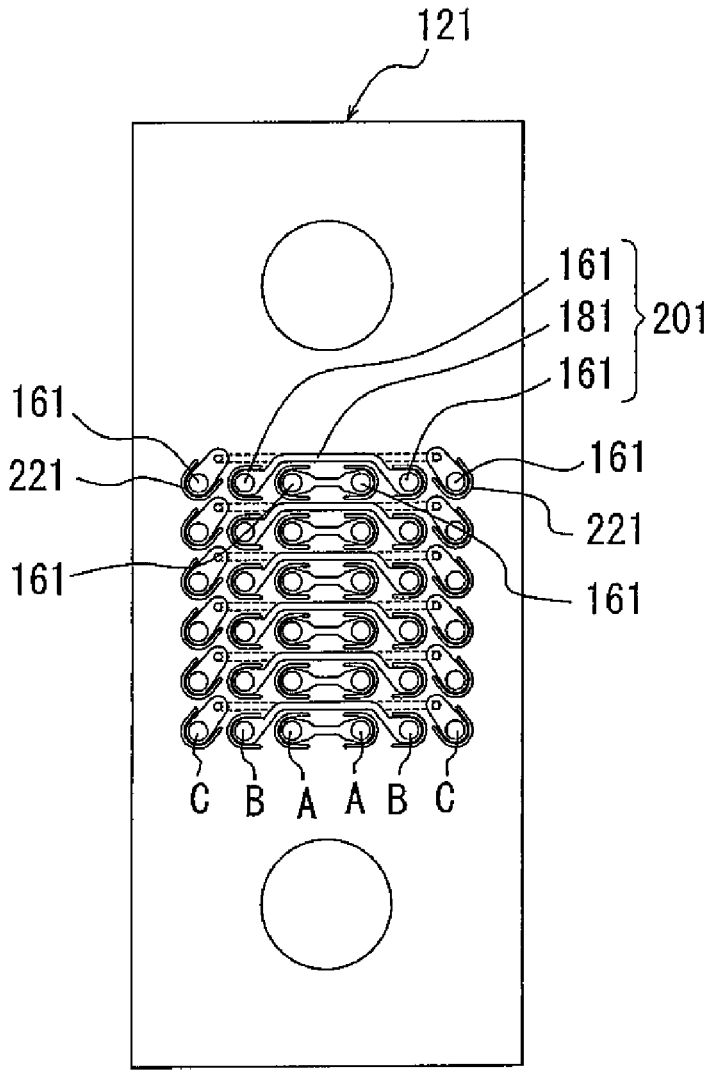
FIG. 16A is a plan view of a flexible printed circuit board having contact conductors whose contact portions of three adjacent contact conductors are arranged in a straight line in the width direction, and contact portions on one side and the other side are arranged in grid shapes, respectively.
Figure 16B:
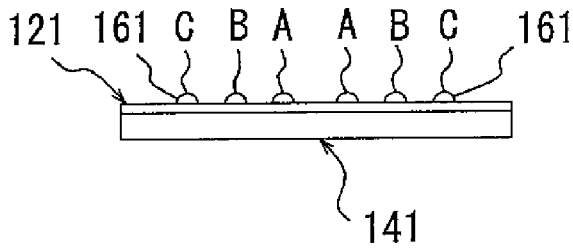
FIG. 16B is a side views illustrating the connector with contact conductors arranged as in FIG. 16A.
Figure 17:
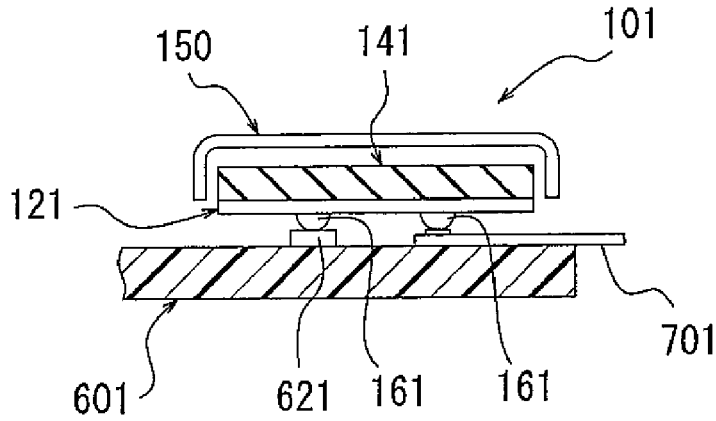
FIG. 17 is a sectional view illustrating the connector according to the invention connecting two connecting objects.
Figure 18:
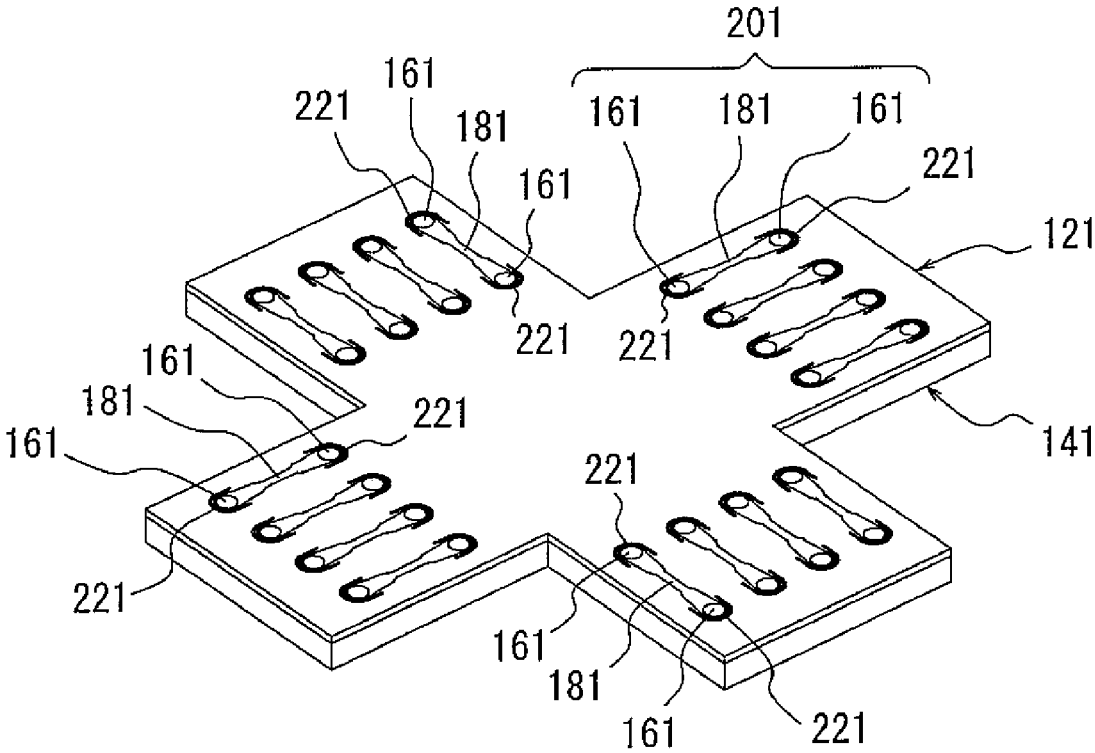
FIG. 18 is a perspective view of a connector as another embodiment of the invention with a substantially cross-shaped flexible printed circuit board whose four parts are provided with a plurality of contact conductors, viewed from the front face of the circuit board.

A further embodiment of the connector according to the invention defined in claims 2, 3 to 16 will be explained with reference to FIGS. 10A to 17. FIG. 10A is a perspective view of the connector viewed from the contacting side, and FIG. 10B is a perspective view of the connector viewed from the opposite side of the contacting side. FIG. 11A is a partly enlarged view of the contact portion, while FIG. 11B is a sectional view of the contact portion taken along its center. FIG. 12A is a plan view of a flexible printed circuit board having contact conductors arranged in a row viewed from the contacting side, and FIG. 13A is a plan view of a flexible printed circuit board having contact conductors arranged in a plurality of rows and their lengths are equal and whose contact portions are arranged to be staggered, viewed from the contacting side. FIG. 14A is a plan view of a flexible printed circuit board having contact conductors arranged in a plurality of rows and whose contact portions are arranged in the longitudinal direction to be staggered to occupy mutually shifted positions alternately one by one. FIG. 15A is a plan view of a flexible printed circuit board having contact conductors whose contact portions of two adjacent contact conductors are arranged in a straight line in the width direction, and contact portions on one side and the other side are arranged in grid shapes, respectively. FIG. 16A is a plan view of a flexible printed circuit board having contact conductors whose contact portions of three adjacent contact conductors are arranged in a straight line in the width direction, and contact portions on one side and the other side are arranged in grid shapes, respectively. FIG. 17 is a sectional view illustrating the connector according to the invention connecting two connecting objects. FIG. 18 is a perspective view of a connector as another embodiment of the invention with a substantially cross-shaped flexible printed circuit board whose four parts are provided with a plurality of contact conductors, viewed from the front face of the circuit board. FIGS. 12B, 13B, 14B, 15B and 16B are side views illustrating the connectors constructed as in FIGS. 12A to 16A, respectively.

The connector 101 according to the embodiment of the invention shown in these drawings mainly comprises the flexible printed circuit board 121, an elastic member 141, and at least one pushing member 15.

At first, said flexible printed circuit board 121 will be explained. Said flexible printed circuit board 121 at least includes a plurality of contact portions 161 to contact connecting objects. The shape of the contact portions 161 is suitably designed so as to be most suitable for the connecting objects. The term "most suitable for" used herein is to be understood as signifying, for example, a hemispherical protrusion if the mating shape is flat as in the illustrated embodiment, or a flat shape or a protrusion like a mountain if the mating shape is a hemispherical protrusion. Moreover, the circuit board 121 is formed with a U-shaped slit 221 partly surrounding each of said contact portions 161 as shown in FIG. 11A. By forming the U-shaped slit 221, the contact portion 161 is supported by a cantilever so that upon contacting a mating connecting object, the contact portion 161 is elastically deformed or displaced, thereby accommodating the irregularity or variation in height of the contact portions 161. For such a purpose, an elastic member 141 is provided on the flexible printed circuit board 121 on the opposite side of contact portions 161. The size of said elastic member 141 is substantially equal to the part of the circuit board 121 on which said contact portions 161 are provided. The thickness of the elastic member 141 may be suitably designed in consideration of displacement of said contact portions 161 and a reduced overall height of the connector 101. Moreover, said elastic member 141 is varied in shape in order to make uniform the contact pressure of the flexible printed circuit board 121 against the connecting object or the contact pressure of the connecting object against the flexible printed circuit board 121. In the illustrated embodiment, the elastic member 141 is curved at its center.

The connector 101 according to the invention is for connecting two connecting objects (for example, connecting two substrates 601, connecting a substrate 601 and a flexible printed circuit board, connecting a substrate 601 and flexible printed circuit board cables, and connecting an electronic appliance and a substrate 601). Therefore, the two contact portions 161 provided on said flexible printed circuit board 121 are connected in continuity with each other through a conductor 181 to form one contact conductor (having the two contact portions 161 and the conductor 181 bringing the two contact portions 161 into continuity with each other). A plurality of said contact conductors 201 are arranged in a manner that the contact portions 161 are connected to contacts of connecting objects, respectively.

The expression "in a manner that contact portions 161 are connected to contacts of a connecting object" means that the contact portions 161 are provided at locations corresponding to positions of contacts provided on the connecting objects, respectively. Moreover, the term "at least one pushing member 15" as used herein is to be understood to mean that two pushing members 15 may be provided for the purpose of pushing the contact portions 161 on one side and the contact portions 161 on the other side of the contact conductors 201 in different directions, respectively.

One embodiment of the connector is shown in FIGS. 10A and 10B. In this embodiment, a plurality of contact conductors 201 are arranged in parallel with one another on a flexible printed circuit board 121, and the elastic member 141 is arranged on the circuit board on the opposite side of the contact conductors. Contact portions 161 of the contact conductors 201 thus arranged are connected to contacts of connecting objects. The arrangement of the contact conductors 201 will be explained with reference to the drawings hereafter.

FIG. 12A illustrates a state that a plurality of contact conductors 201 are arranged in a row in the longitudinal direction of a circuit board 121. In other words, the contact conductors 201 each including two contact portions 161 and a conductor 181 connecting said two contact portions 161 in continuity with each other are arranged in the row with a constant pitch in the longitudinal direction. The spacing between the adjacent contact conductors 201 will be determined by the machining technique for the U-shaped slits 221 and the size (height) of said contact portions 161, and the spacing can be of the order of 300 μm at the minimum.

FIG. 13A illustrates a state that the contact conductors 201 have the same length (the distances between A and A of the contact portions 161 and between B and B of the contact portions 161 of the contact conductors 201 are equal to each other) and are arranged in two rows so that the contact portions are staggered to occupy mutually shifted positions alternately one by one. The two adjacent contact conductors 201 form a pair of contact conductors, and the pairs of contact conductors 201 are arranged in one row with a constant pitch in the longitudinal direction of the flexible printed circuit board. The spacing between the adjacent pairs of said contact conductor 201 will be determined by the machining technique for the U-shaped slits 221 and the size (height) of said contact portions 161, and the spacing can be of the order of 300 μm at the minimum. As the distances between the contact portions 161 of the contact conductors 201 are equal, resistances become equal and further the skews (time differences of a plurality of signals through the paths) become also equal.

FIG. 14A illustrates a state that the contact portions 161 of said contact conductors 201 are arranged in a plurality of rows and staggered to occupy mutually shifted positions alternately one by one in the longitudinal direction. The two adjacent contact conductors 201 form a pair of contact conductors, and the pairs of the contact conductors 201 are arranged in a row with a constant pitch in a longitudinal direction of the circuit board.

FIG. 15A illustrates a state that the contact portions 161 of the two adjacent contact conductors 201 are arranged in a straight line in the width direction of the circuit board, and the contact portions 161 of on one side and the contact portions 161 on the other side are arranged in grid shapes, respectively. In other words, the contact portions 161 of the two adjacent contact conductors 201 are arranged in the same straight line in the width direction of the circuit board, and the conductors 181 connecting said contact portions 161 are arranged in two rows. The two adjacent contact conductors 201 whose contact portions 161 are arranged in the same straight line form a pair of contact conductors 201, and the pairs of the contact conductors 201 are arranged in the longitudinal direction of the circuit board in a row with a constant pitch, and said contact portions 161 on one side and said contact portions 161 on the other side are arranged in grid shapes, respectively.

FIG. 16A illustrates a state that the contact portions 161 of the three adjacent contact conductors 201 are arranged to be aligned in a straight line, and the contact portions 161 on one side and the contact portions 161 on the other side are arranged in grid shapes, respectively. In other words, the contact portions 161 of the three adjacent contact conductors 201 are arranged in the same straight line in the width direction of the circuit board, and the conductors 181 connecting said contact portions 161 are arranged in two rows (front face side and rear face side). The three adjacent contact conductors 201 whose contact portions 161 are arranged in a straight line in the width direction form one set of contact conductors, and the sets of the contact conductors are arranged in the longitudinal direction of the circuit board in one row with a constant pitch. Said contact portions 161 on one side and the other side are arranged in grid shapes, respectively. The conductors 181 connecting the outermost contact portions 161 are located on the rear side of the circuit board through through-holes. By employing such through-holes, the narrower pitch can be realized.

While the two or three contact conductors 201 whose contact portions 161 are arranged in one straight line are explained and shown in FIG. 15A or 16A, it will be apparent that contact portions 161 of four or more contact conductors may be arranged in one straight line. In this case, however, pitches of the adjacent contact conductors 201 arranged on a circuit board may be suitably designed depending upon how the conductors 18 causing two contact portions to be in continuity with each other are arranged.

The pushing member 15 will then be explained. The pushing member 15 is for pushing the connector 101 according to the invention against connecting objects, and may be any one so long as it can push the connector to the connecting objects and may be suitably designed in consideration of a reduced overall height of the connector 101 and convenient operation for pushing. In the illustrated embodiment, for example, an inversed U-shaped member shown in FIG. 17 is pushed to the elastic members 141 (pushed toward the connecting object) so as to be pushed toward the substrate 601 by hooking or screw fastening. In other words, contact portions 161 on one side of said contact conductors 201 are pushed to lands 621 of the substrate 601, and the contact portions 161 on the other side are pushed to contacts of the flexible printed circuit board cables 701 by means of said pushing member 15.

There are cases that the connector 101 according to the invention is pushed toward the connecting objects, that the connecting objects are pushed toward the connector 101, and that the connector 101 is pushed to one connecting object and the other connecting object is pushed to the connector 101.

Moreover, said pushing member 15 may be an integrally formed member or may be members divided for said contact portions 161 at both ends of said contact conductors 201.

FIG. 17 is a sectional view of the connector according to the invention connecting two connecting objects. In this way, the connector 101 according to the invention is merely pushed to the two connecting objects to achieve the connection of the two connecting objects. In FIG. 17, for example, one of the connecting objects is the substrate 601 and the other is the flexible printed circuit board cables 701. In other words, the contact portions 161 of said contact conductors 201 on one side are pushed to lands 621 of the substrate 601, and the contact portions 161 on the other side are pushed to contacts of the flexible printed circuit board cables 701 by means of said pushing member 15. Either or both may be soldered, as the case may be.

Another embodiment will be explained with reference to FIG. 18. FIG. 18 is a perspective view of a substantially cross-shaped flexible printed circuit board whose four parts are provided with a plurality of contact conductors, viewed from the front face of the circuit board. Depending upon requirements or specifications of customers, two connecting objects of a plurality of kinds can be connected by providing a required number of the contact conductors 201 at predetermined positions of a part or parts of the flexible printed circuit board 121 (at positions for connecting the contacts of the connecting objects and the contact portions 161 of said contact conductors 201). The expression "a part or parts" as used herein is to be understood to mean that only one part or two or more parts of a flexible printed circuit board 121 may be provided with the contact conductors, and locations where the contact conductors are arranged on the flexible printed circuit board may be suitably designed correspondingly to locations of contacts of the connecting objects. In the illustrated embodiment, the four parts of the substantially cross-shaped flexible printed circuit board are provided with a plurality of contact conductors so that the two connecting objects are connected at the four locations.

Moreover, a plurality of connectors 101 each employing a flexible printed circuit board 121 in a manner corresponding to the contact conductors 201 are used to enable plural kinds of two connecting objects to be connected, as the case may be.

Figure 19A:
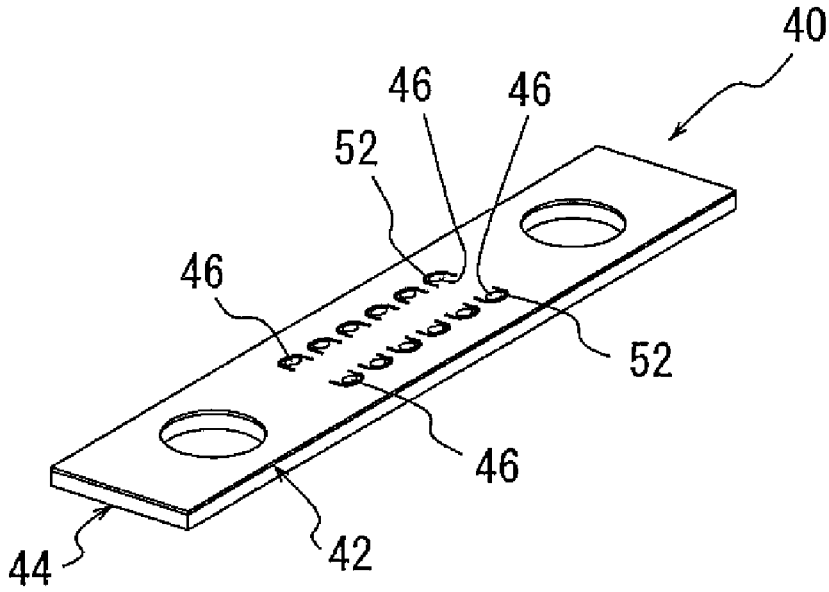
FIG. 19A is a perspective view of a pushing jig viewed from the side of pushing portions.
Figure 19B:
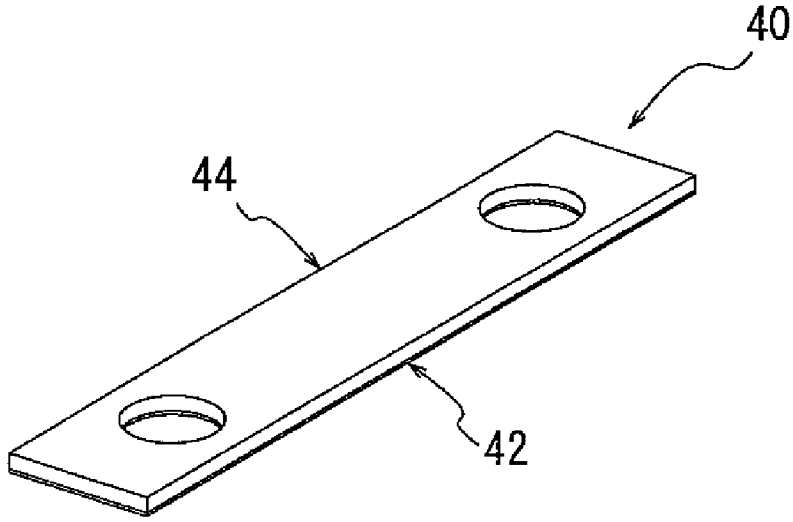
FIG. 19B is a perspective view of the pushing jig viewed from the opposite side of the pushing portions.
Figure 20A:
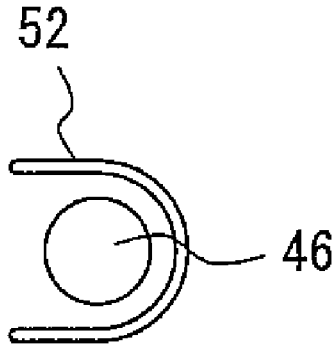
FIG. 20A is a partly enlarged view of the pushing portion.
Figure 20B:
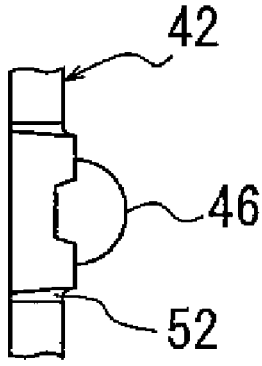
FIG. 20B is a sectional view of the pushing portion taken along its center.
Figure 21A:
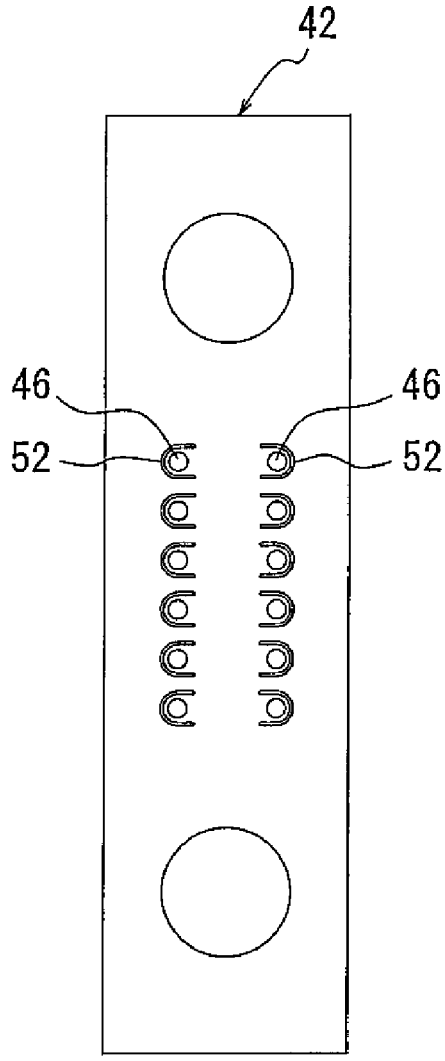
FIG. 21A is a plan view of a base material on which the pushing portions are arranged in a plurality of rows, viewed from the side of the pushing portions.
Figure 21B:
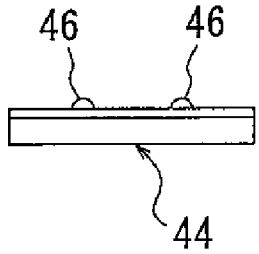
FIG. 21B is a side view of the jig arranged as shown in FIG. 21A.
Figure 22A:
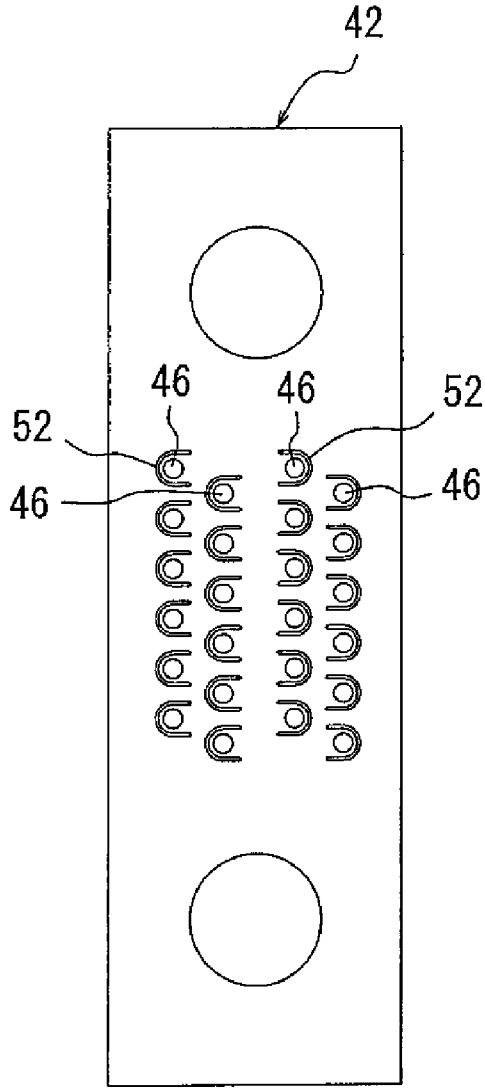
FIG. 22A is a plan view of a base material on which pushing portions are arranged in a plurality of rows to be staggered and distances in the width direction between the two pushing portions are equal, viewed from the side of the pushing portions.
Figure 22B:
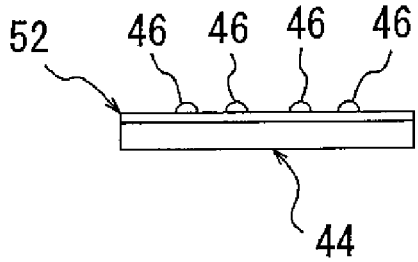
FIG. 22B is a side view of the jig arranged as shown in FIG. 22A.
Figure 23A:
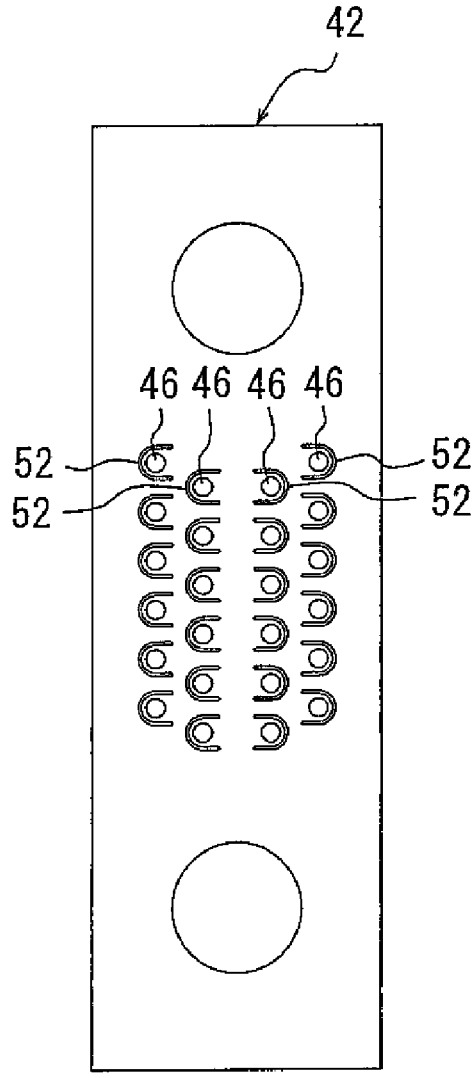
FIG. 23A is a plan view of a base material on which pushing portions are arranged in a plurality of rows in the longitudinal direction of the base material to be staggered to occupy mutually shifted positions alternately one by one.
Figure 23B:
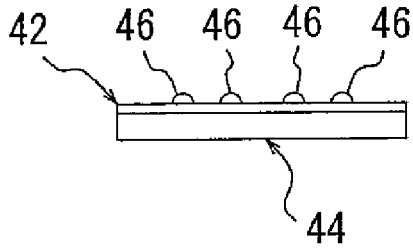
FIG. 23B is a side view of the jig arranged as shown in FIG. 23A.
Figure 24A:
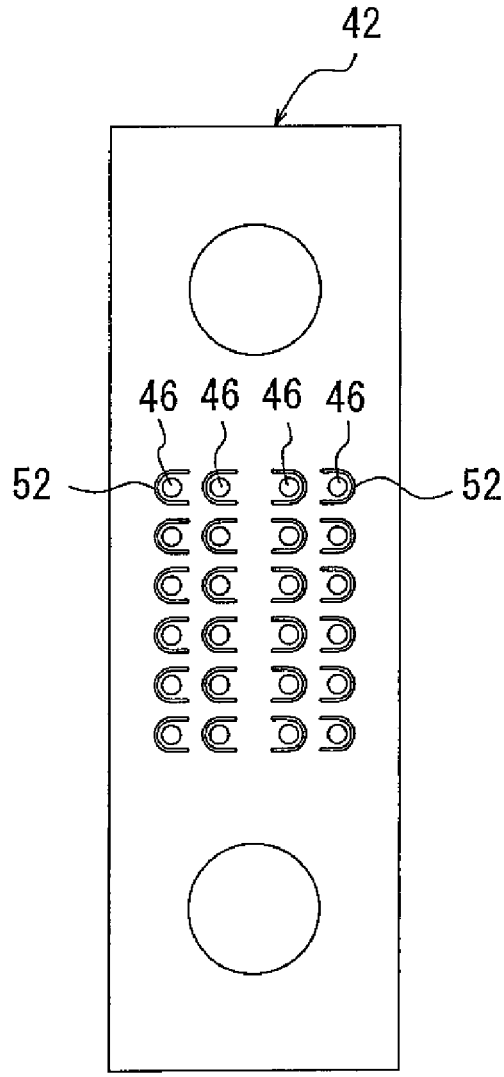
FIG. 24A is a plan view of a base material on which all pushing portions are arranged in a grid shape and the two pushing portions are arranged in a straight line in the width direction of the base material.
Figure 24B:
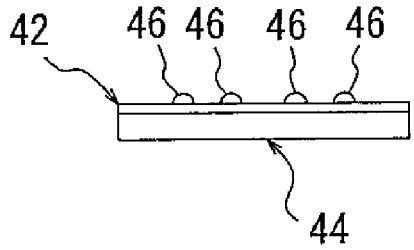
FIG. 24B is a side view of the jig arranged as shown in FIG. 24A.
Figure 25A:
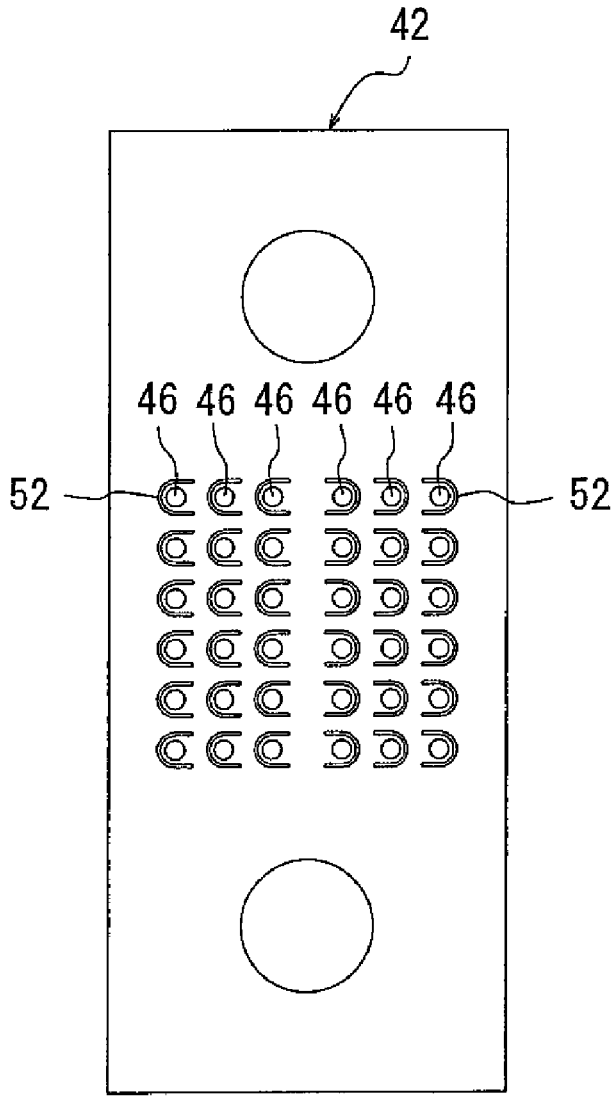
FIG. 25A is a plan view of a base material on which all pushing portions are arranged in a grid shape and the three pushing portions are arranged in a straight line in the width direction of the base material.
Figure 25B:
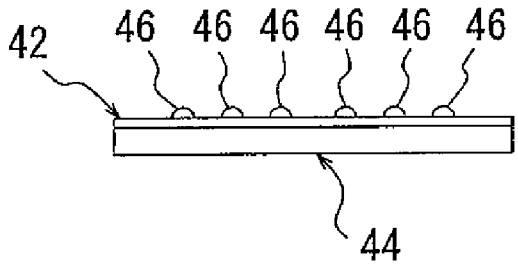
FIG. 25B is a side view of the jig arranged as shown in FIG. 25A.
Figure 26A:
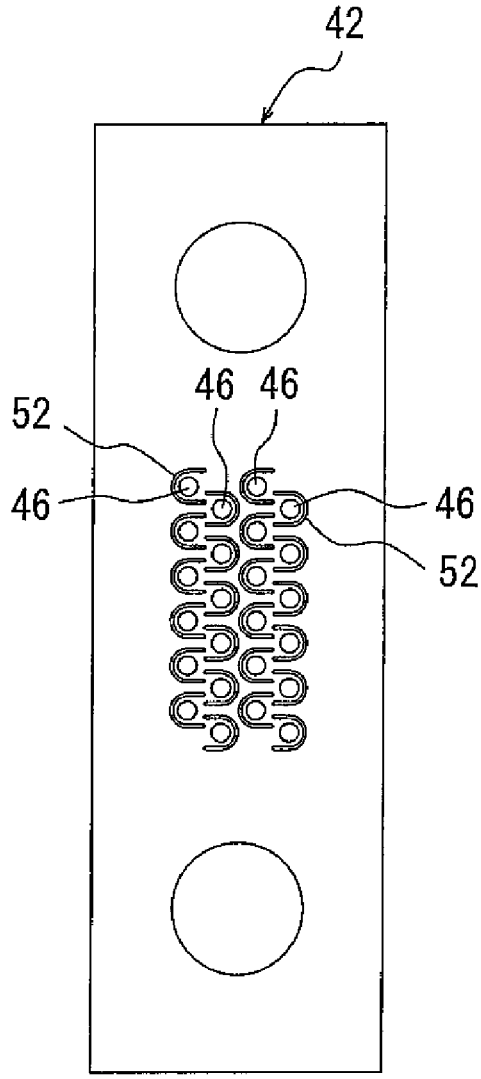
FIG. 26A is a plan view of a base material on which pushing portions are arranged in a plurality of rows in the longitudinal directions of the base material to be staggered to occupy mutually shifted positions alternately one by one so that U-shaped slits of the pushing portions adjacent in the width directions of the vase material are opposite to each other.
Figure 26B:
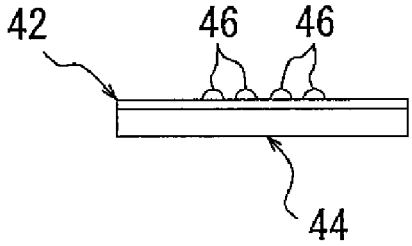
FIG. 26B is a side view of the jig arranged as shown in FIG. 26A.
Figure 27:
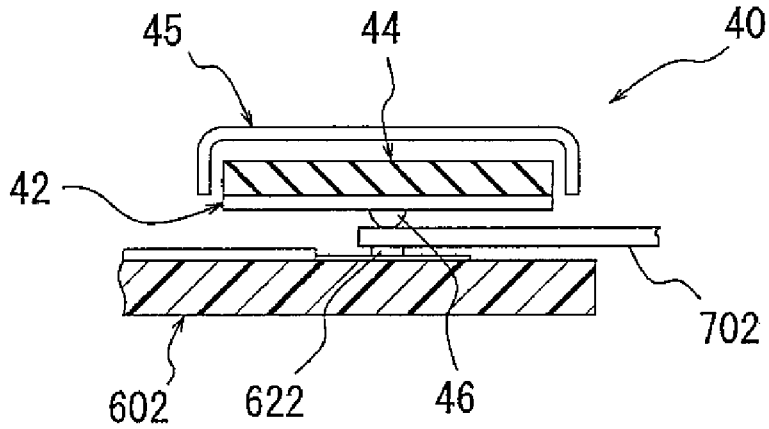
FIG. 27 is a sectional view of a pushing jig according to the invention connecting two connecting objects.
Figure 28:
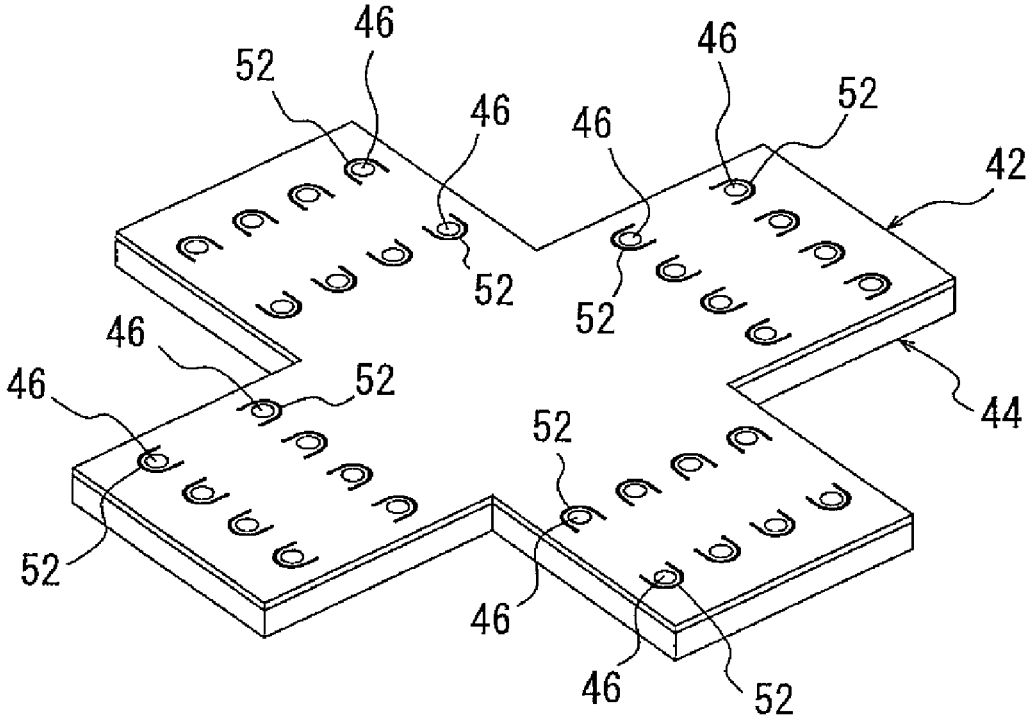
FIG. 28 is a perspective view of a connector as another embodiment of the invention having a substantially cross-shaped base material of four parts provided with a plurality of pushing portions, viewed from the front face.
Figure 29A:
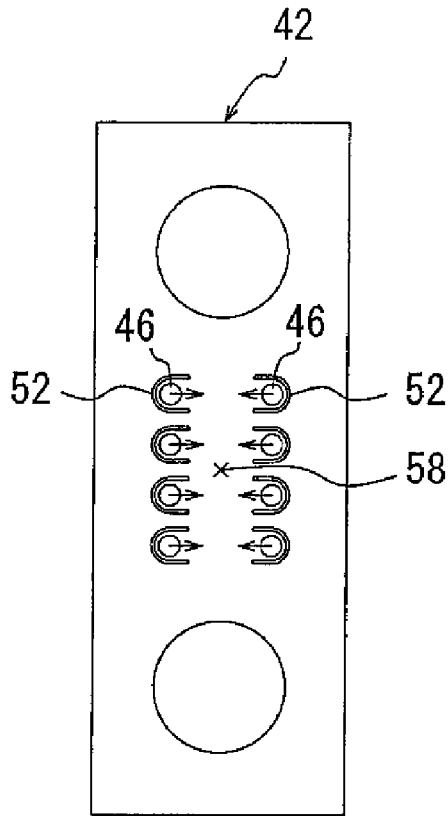
FIGS. 29A and 29B are views for explaining the arrangement of directions of the U-shaped slits.
Figure 29B:
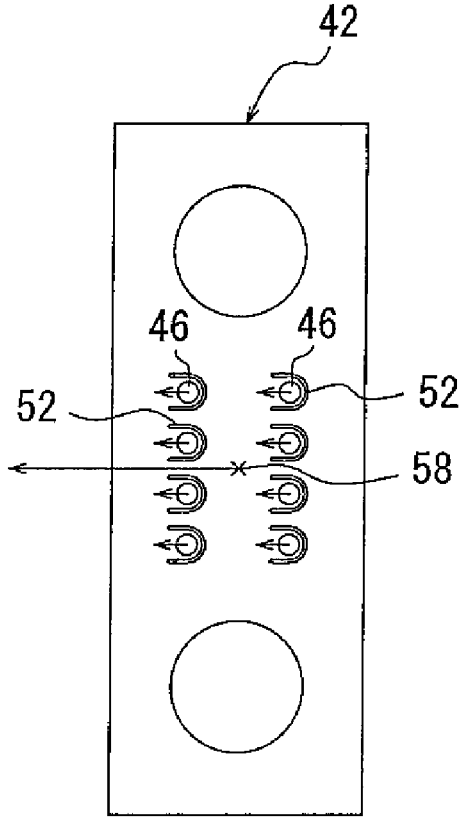

One embodiment of the pushing jig according to the invention defined in claims 17 to 23 for pushing the connector against mating objects will be explained with reference to FIG. 19A to 29B. FIG. 19A is a perspective view of a pushing jig viewed from the side of pushing portions, and FIG. 19B is a perspective view of the pushing jig viewed from the opposite side of the pushing portions. FIG. 20A is a partly enlarged view of the pushing portion, and FIG. 20B is a sectional view of the pushing portion taken along its center. FIG. 21A is a plan view of a base material on which the pushing portions are arranged in a plurality of rows, viewed from the side of the pushing portions. FIG. 22A is a plan view of a base material on which pushing portions are arranged in a plurality of rows to be staggered and distances in the width direction between the two pushing portions are equal, viewed from the side of the pushing portions. FIG. 23A is a plan view of a base material on which pushing portions are arranged in a plurality of rows in the longitudinal direction of the base material to be staggered to occupy mutually shifted positions alternately one by one. FIG. 24A is a plan view of a base material on which all pushing portions are arranged in a grid shape and the two pushing portions are arranged in a straight line in the width direction of the base material. FIG. 25A is a plan view of a base material on which all pushing portions are arranged in a grid shape and the three pushing portions are arranged in a straight line in the width direction of the base material. FIG. 26A is a plan view of a base material on which pushing portions are arranged in a plurality of rows in the longitudinal directions of the base material to be staggered to occupy mutually shifted positions alternately one by one so that U-shaped slits of the pushing portions adjacent in the width directions of the vase material are opposite to each other. FIG. 27 is a sectional view of a connector according to the invention connecting two connecting objects. FIG. 28 is a perspective view of a connector as another embodiment of the invention having a substantially cross-shaped base material of four parts provided with a plurality of pushing portions, viewed from the front face. FIGS. 29A and 29B are views for explaining the arrangement of directions of the U-shaped slits. FIGS. 21B, 22B, 23B, 24B, 25B and 26B are side views of the jigs arranged as shown in FIGS. 21A, 22A, 23A, 24A, 25A and 26A, respectively.

The pushing jig 40 according to the invention mainly comprises a base material 42, an elastic member 44, and a pushing member 45.

At first, the base material 42 will be explained. Said base material 42 is provided with at least a plurality of pushing portions 46 for pushing connecting objects. The shape of said pushing portions 46 may be suitably designed so as to be most suitable for the shape of the connecting objects. The term "most suitable for" used herein is to be understood as signifying, for example, a hemispherical protrusion if the mating shape is flat as in the illustrated embodiment, or a flat shape or a protrusion like a mountain if the mating shape is a hemispherical protrusion. Moreover, the base material 42 is formed with a U-shaped slit 52 partly surrounding each said pushing portions 46 as shown in FIG. 20A. By forming the U-shaped slit 52, the pushing portion 46 is supported by a cantilever so that upon contacting a mating connecting object, the pushing portion 46 is elastically deformed or displaced, thereby accommodating the irregularity or variation in height of the pushing portions 46. For such a purpose, an elastic member 44 is provided on the side of the base material 42 opposite from the pushing portions 46. The size of said elastic member 44 is substantially equal to the part of the base material 42 on which said pushing portions 46 are provided. The thickness of the elastic member 44 may be suitably designed in consideration of displacement of said pushing portions 46 and a reduced overall height of the pushing jig 40. Moreover, said elastic member 44 is varied in shape in order to make uniform the contact pressure of the base material 42 to the connecting objects or the contact pressure of the connecting objects to the base material 42. In the illustrated embodiment, the elastic member 44 is curved at its center.

The pushing jig 40 according to the invention is for connecting two connecting objects (for example, connecting two substrates 602, connecting a substrate 602 and a flexible printed circuit board, connecting a substrate 602 and flexible printed circuit board cables 702, connecting an electronic appliance and a substrate 602, and the like). Therefore, the pushing jig 40 has a construction having the base material 42 on which a plurality of the pushing portions 46 are formed and arranged at predetermined positions for pushing one connecting object.

The term "predetermined positions" as used herein is to be understood to mean the locations where said pushing portions 46 are arranged so as to correspond to contacts of the connection object. The arrangements of said pushing portions 46 will then be explained with reference to the drawings.

FIG. 21A illustrates a state that said pushing portions 46 are arranged in a plurality of rows. In other words, the two pushing portions 46 are arranged in parallel with each other in the width direction of the base material and all the pushing portions 46 are arranged in a plurality of rows with a constant pitch in the longitudinal direction of the base member. The spacing between the adjacent pushing portions 46 will be determined by the machining technique for the U-shaped slits 52 and the size (height) of said pushing portions 46, and the spacing can be of the order of 300 μm at the minimum.

FIG. 22A illustrates a state that the pushing portions 46 are arranged in a plurality of rows in the longitudinal direction of the base material to be staggered to occupy mutually shifted positions alternately one by one relative to each other, and distances between the two pushing portions 46 in the width direction of the base material are equal. The pushing portions 46 arranged in the longitudinal direction to be staggered to occupy mutually shifted positions alternately one by one are arranged in the plurality of rows. The spacing between the pushing portions 46 adjacent in the longitudinal direction of the base material will be determined by the machining technique for the U-shaped slits 52 and the size (height) of said pushing portion 46, and the spacing can be of the order of 300 μm at the minimum.

FIG. 23A illustrates a state that said pushing portions 46 are arranged in the longitudinal direction of the base material to be staggered to occupy mutually shifted positions alternately one by one, and such pushing portions are arranged in a plurality of rows. In other words, in the state that said pushing portions 46 are staggered to occupy mutually shifted positions alternately one by one relative to each other, the pushing portions arranged in such a manner are arranged in a plurality of rows.

FIG. 24A illustrates a state that the two pushing portions 46 are arranged in a straight line in the width direction and the pushing portions on one side and the other side are arranged in grid shapes, respectively. In other words, the two pushing portions 46 are arranged in a straight line in the width direction, and in this condition (the two pushing portions 46 are arranged in a straight line in the width direction), they are arranged in a plurality of rows.

FIG. 25A illustrates a state that the three pushing portions 46 are arranged in a straight line in the width direction and the pushing portions on one side and the other side are arranged in grid shapes, respectively. In other words, the three pushing portions 46 are arranged in a straight line in the width direction, and in this condition (the three pushing portions 46 are arranged in a straight line in the width direction), they are arranged in a plurality of rows.

FIG. 26A illustrates a state that the pushing portions are arranged in the longitudinal direction of the base material to be staggered to occupy mutually shifted positions alternately one by one and the thus staggered pushing portions are arranged in a plurality of rows in a manner that the U-shaped slits 52 of the two pushing portions adjacent to each other in the width direction of the base material are facing to each other in respective rows. In other words, as the U-shaped slits 52 of the two pushing portions adjacent in the width direction on one side and the other side are arranged opposite to each other, the spacing or pitches between the pushing portions adjacent in the width direction and the longitudinal direction will become narrower than those in FIGS. 22A to 25A. With such an arrangement in FIG. 26A, the spacing can be 200 μm in the longitudinal direction and 350 μm in the width direction at the minimum.

Although the two or three pushing portions 46 arranged in one straight line in the width direction of the base material are shown and explained in FIGS. 24A to 26A, it is to be understood that four or more pushing portions may be arranged in one straight line in the width direction.

The pushing member 45 will then be explained. The pushing member 45 is for pushing the pushing jig 40 according to the invention toward connecting objects, and may be any one so long as it can push the pushing jig and may be suitably designed in consideration of a reduced overall height of the pushing jig 40 and convenient operation for pushing. In the illustrated embodiment, for example, a substantially inverted U-shaped member as shown in FIG. 27 is pushed to said elastic member 44 (pushed toward the connecting objects) so as to be pushed to a substrate 602 by hooking or screw fastening. In other words, one connecting object (for example, flexible printed circuit board cables 702) is pushed by the pushing portions 46 so that contacts of said flexible printed circuit board cables 702 are brought into contact with lands 622 of the other connecting object (for example, substrate 602), thereby causing the substrate 602 and the flexible printed circuit board cables 702 to be in electrical continuity.

There may be cases that the pressing jig 40 is pushed to connecting objects, and that connecting objects are pushed to the pressing jig 40 according to the invention.

FIG. 27 is a sectional view of the pushing jig 40 according to the invention connecting two connecting objects. In this way, by using the pushing jig 40 according to the invention, only one of the connecting objects is pushed to achieve the connection of the two connecting objects. In FIG. 27, for example, one connecting object is the substrate 602, and the other connecting object is the flexible printed circuit board cables 702.

Finally, directions of the U-shaped slits 52 will be explained. The directions of the U-shaped slits are so arranged that vectors (amounts and directions) of forces applied to the pushing portions 46 become zero at the center 58 of said pushing jig 40 upon the connecting object being pushed by said pushing jig 40. With such an arrangement of the directions of the U-shaped slits 52, stable pushing can be realized. Explaining further using FIGS. 29A and 29B, U-shaped slits 52 face to each other in FIG. 29A, and U-shaped slits 52 face in the same direction in FIG. 29B. The vector of force applied to the pushing portion 46 is directed to the proximal end of a cantilever formed by and surrounded by the U-shaped slit 52 as shown by many small arrows in the drawings. In FIG. 29A, therefore, the vectors are directed toward each other and canceled out so that the vector at the center 58 of the jig 40 becomes zero. On the other hand, in FIG. 29B, as the U-shaped slits are directed in the same direction, all the vectors applied to the eight pushing portions 46 are added so that the vector at the center 58 of the jig 40 becomes eight times the vector at the one pushing portion 46.

Examples of applications of the invention are connectors for connecting substrates or connecting a substrate and a flexible printed circuit board, which are used in various electric and electronic appliances, and more particularly connectors achieving narrower pitches and higher mounting density.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector comprising a plurality of contact conductors each having two contact portions and a conductor for connecting said two contact portions to be in electrical continuity, a flexible printed circuit board on which said plurality of contact conductors are arranged so that said contact portions can be connected to contacts of connecting objects, said flexible printed circuit board being folded back at a predetermined position to arrange said contact portions on the front and rear faces of the folded flexible printed circuit board, and an elastic member arranged between said contact portions on the front and rear faces of said folded flexible printed circuit board, wherein a substantially U-shaped slit is provided partly surrounding each of the contact portions of said contact conductors.

2. The connector as set forth in claim 1, wherein said flexible printed circuit board provided with said plurality of contact conductors arranged in parallel with one another is folded back substantially along a center line of its width so that said contact portions on the front and rear faces of the folded flexible printed circuit board are arranged in aligned positions on the front and rear faces.

3. The connector as set forth in claim 1, wherein said elastic member is varied in shape in order to make uniform the contact pressure of said, flexible printed circuit board to said connecting objects or the contact pressure of said connecting objects to said flexible printed circuit board.

4. The connector as set forth in claim 2, wherein all said contact conductors have equal lengths between the two contact portions, and such contact conductors are arranged in the longitudinal direction of the flexible printed circuit board so that said contact portions are arranged to be staggered to occupy mutually shifted positions alternately one by one so that a pitch narrower than the pitch of connector is possible.

5. The connector as set forth in claim 2, wherein said contact conductors are arranged in the longitudinal direction of the flexible printed circuit board so that the contact portions of said contact conductors are staggered to occupy mutually shifted positions alternately one by one and the contact portions of said contact conductors arranged on the front and rear faces of the folded flexible printed circuit board are arranged in aligned positions on the front and rear faces.

6. The connector as set forth in claim 2, wherein the contact portions of the two adjacent contact conductors are arranged in the same straight line in the width direction of the flexible printed circuit board, and said contact portions on the front and rear faces of the folded flexible printed circuit board are arranged in grid shapes, respectively, and are arranged in aligned positions on the front and rear faces.

7. The connector as set forth in claim 2, wherein the contact portions of the three adjacent contact conductors are arranged in the same straight line in the width direction of the flexible printed circuit board, and said contact portions on the front and rear faces of the folded flexible printed circuit board are arranged in grid shapes, respectively, and are arranged in aligned positions on the front and rear faces.

8. The connector as set forth in claim 2, wherein the contact portions of the four or more adjacent contact conductors are arranged in the same straight line in the width direction of the flexible printed circuit board, and said contact portions on the front and rear faces of the folded flexible printed circuit board are arranged in grid shapes, respectively, and in aligned positions on the front and rear faces.

9. The connector as set forth in claim 8, wherein a part or parts of said flexible printed circuit board are folded back at predetermined positions.

10. The connector as set forth in claim 3, wherein a plurality of said contact conductors are arranged in parallel with one another.

11. The connector as set forth in claim 10, wherein all said contact conductors have equal lengths between the two contact portions, and such contact conductors are arranged in the longitudinal direction of the flexible printed circuit board so that said contact portions are arranged to be staggered to occupy mutually shifted positions alternately one by one so that a pitch narrower than the pitch of connector is possible.

12. The connector as set forth in claim 10, wherein the two adjacent contact conductors have different lengths between the two contact portions, and such contact conductors are arranged in the longitudinal direction of the flexible printed circuit board so that said contact portions are arranged to be staggered to occupy mutually shifted positions alternately one by one.

13. The connector as set forth in claim 10, wherein the contact portions of a plurality of said contact conductors are arranged in the same straight line in the width direction of the flexible printed circuit board, and said contact portions on one side and on the other side are arranged in grid shapes, respectively.

14. The connector as set forth in claim 13, wherein one or more of parts of said flexible printed circuit board are provided with a plurality of the contact conductors at predetermined positions.

15. A connector comprising a plurality of contact conductors each haying two contact portions and a conductor for connecting said two contact portions to be in electrical continuity, a flexible printed circuit board on which said plurality of contact conductors are arranged so that said contact portions can be connected to contacts of connecting objects, an elastic member held on the side of said flexible printed circuit board opposite from the side provided with said contact portions, wherein a substantially U-shaped slit is provided partly surrounding each of the contact portions of said contact conductors.

* * * * *